US006425448B1

(12) United States Patent
Zupanick et al.

(10) Patent No.: US 6,425,448 B1
(45) Date of Patent: Jul. 30, 2002

(54) METHOD AND SYSTEM FOR ACCESSING SUBTERRANEAN ZONES FROM A LIMITED SURFACE AREA

(75) Inventors: Joseph A. Zupanick, Pineville, WV (US); Monty H. Rial, Dallas, TX (US)

(73) Assignee: CDX Gas, L.L.P., Dallas, TX (US)

( * ) Notice: Subject to any disclaimer, the term of this patent is extended or adjusted under 35 U.S.C. 154(b) by 0 days.

(21) Appl. No.: 09/773,217

(22) Filed: Jan. 30, 2001

(51) Int. Cl.[7] ..... E21B 7/04

(52) U.S. Cl. ..... 175/61; 175/62; 166/50; 166/52; 166/245

(58) Field of Search ..... 175/61, 57, 62; 166/50, 52, 245

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Böll et al. | 255/24 |
| 2,335,085 | A | 11/1943 | Roberts | 251/107 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |

(List continued on next page.)

FOREIGN PATENT DOCUMENTS

| | | | |
|---|---|---|---|
| DE | 197 25 996 A1 | 1/1998 | E03B/3/10 |
| EP | 0 819 834 A1 | 1/1998 | E21B/43/28 |
| EP | 0 875 661 A1 | 11/1998 | E21B/43/30 |
| EP | 0 952 300 A1 | 10/1999 | E21B/7/12 |
| WO | 94/21889 | 9/1994 | E21B/43/24 |

OTHER PUBLICATIONS

Weiguo Chi & Luwu Yang, "Feasibility of Coalbed Methane Exploitation in China," Horizontal Well Technology, p. 74, Sep. 2001.

Gopal Ramaswamy, "Production History Provides CBM Insights," Oil & Gas Journal pp. 49, 50 & 52, Apr. 2, 2001.

Gopal Ramaswamy, "Advances Key For Coalbed Methane," The American Oil & Gas Reporter, pp. 71 & 73, Oct. 2001.

(List continued on next page.)

*Primary Examiner*—David Bagnell
*Assistant Examiner*—John Kreck
(74) *Attorney, Agent, or Firm*—Baker Botts L.L.P.

(57) ABSTRACT

A method and system for accessing subterranean zones from the surface includes a substantially vertical well bore extending from the surface to a target zone, and an articulated well bore extending from the substantially vertical well bore to the target zone. The articulated well bore diverges from the substantially vertical well bore between the surface and the target zone. The system also includes a well bore pattern extending from the articulated well bore in the target zone operable to collect resources from the target zone. The system also includes a subsurface channel operable to communicate resources from the well bore pattern to the substantially vertical well bore. The system further includes a vertical pump disposed in the substantially vertical well bore and operable to lift resources collected in the substantially vertical well bore to the surface.

35 Claims, 12 Drawing Sheets

U.S. PATENT DOCUMENTS

| | | | | | |
|---|---|---|---|---|---|
| 2,847,189 | A | | 8/1958 | Shook | 255/76 |
| 2,911,008 | A | | 11/1959 | Du Bois | 137/625.31 |
| 2,980,142 | A | | 4/1961 | Turak | 137/637.3 |
| 3,347,595 | A | | 10/1967 | Dahms et al. | 299/4 |
| 3,443,648 | A | | 5/1969 | Howard | 175/103 |
| 3,473,571 | A | | 10/1969 | Dugay | 137/625.4 |
| 3,503,377 | A | | 3/1970 | Beatenbough et al. | 123/117 |
| 3,528,516 | A | | 9/1970 | Brown | 175/267 |
| 3,530,675 | A | | 9/1970 | Turzillo | 61/35 |
| 3,684,041 | A | | 8/1972 | Kammerer, Jr. et al. | 175/267 |
| 3,692,041 | A | | 9/1972 | Bondi | 137/238 |
| 3,757,876 | A | | 9/1973 | Pereau | 175/267 |
| 3,757,877 | A | | 9/1973 | Leathers | 175/269 |
| 3,800,830 | A | | 4/1974 | Etter | 137/625.41 |
| 3,809,519 | A | | 5/1974 | Garner | 425/245 |
| 3,825,081 | A | | 7/1974 | McMahon | 175/73 |
| 3,828,867 | A | | 8/1974 | Elwood | 175/45 |
| 3,874,413 | A | | 4/1975 | Valdez | 137/625.47 |
| 3,902,322 | A | | 9/1975 | Watanabe | 61/35 |
| 3,934,649 | A | | 1/1976 | Pasini, III et al. | 166/254 |
| 3,957,082 | A | | 5/1976 | Fuson et al. | 137/625.41 |
| 3,961,824 | A | | 6/1976 | Van Eek et al. | 209/17 |
| 4,037,658 | A | | 7/1977 | Anderson | 166/272 |
| 4,073,351 | A | | 2/1978 | Baum | 175/14 |
| 4,089,374 | A | | 5/1978 | Terry | 166/259 |
| 4,116,012 | A | | 9/1978 | Abe et al. | 405/238 |
| 4,156,437 | A | | 5/1979 | Chivens et al. | 137/554 |
| 4,169,510 | A | | 10/1979 | Meigs | 175/65 |
| 4,189,184 | A | | 2/1980 | Green | 299/8 |
| 4,220,203 | A | | 9/1980 | Steeman | 166/271 |
| 4,221,433 | A | | 9/1980 | Jacoby | 299/4 |
| 4,257,650 | A | | 3/1981 | Allen | 299/2 |
| 4,278,137 | A | | 7/1981 | Van Eek | 175/267 |
| 4,296,785 | A | | 10/1981 | Vitello et al. | 141/105 |
| 4,299,295 | A | | 11/1981 | Gossard | 175/45 |
| 4,312,377 | A | | 1/1982 | Knecht | 137/625.19 |
| 4,317,492 | A | | 3/1982 | Summers et al. | 175/79 |
| 4,328,577 | A | | 5/1982 | Abbott et al. | 370/84 |
| 4,366,988 | A | | 1/1983 | Bodine | 299/14 |
| 4,372,398 | A | | 2/1983 | Kuckes | 175/45 |
| 4,386,665 | A | | 6/1983 | Dellinger | 175/61 |
| 4,390,067 | A | | 6/1983 | Willman | 166/245 |
| 4,396,076 | A | | 8/1983 | Inoue | 175/265 |
| 4,397,360 | A | | 8/1983 | Schmidt | 175/61 |
| 4,401,171 | A | | 8/1983 | Fuchs | 175/267 |
| 4,407,376 | A | | 10/1983 | Inoue | 175/267 |
| 4,442,896 | A | | 4/1984 | Reale et al. | 166/278 |
| 4,458,767 | A | * | 7/1984 | Hoehn, Jr. | 166/255.1 |
| 4,494,616 | A | | 1/1985 | McKee | 175/67 |
| 4,512,422 | A | | 4/1985 | Knisley | 175/99 |
| 4,519,463 | A | | 5/1985 | Schuh | 175/61 |
| 4,527,639 | A | | 7/1985 | Dickinson, III et al. | 175/61 |
| 4,532,986 | A | | 8/1985 | Mims, et al. | 166/50 |
| 4,544,037 | A | | 10/1985 | Terry | 166/369 |
| 4,558,744 | A | | 12/1985 | Gibb | 166/335 |
| 4,565,252 | A | | 1/1986 | Campbell et al. | 175/269 |
| 4,573,541 | A | | 3/1986 | Josse et al. | 175/78 |
| 4,599,172 | A | | 7/1986 | Gardes | 210/314 |
| 4,600,061 | A | | 7/1986 | Richards | 175/62 |
| 4,605,076 | A | | 8/1986 | Goodhart | 175/61 |
| 4,611,855 | A | | 9/1986 | Richards | 299/2 |
| 4,618,009 | A | | 10/1986 | Carter et al. | 175/267 |
| 4,638,949 | A | | 1/1987 | Mancel | 239/307 |
| 4,646,836 | A | | 3/1987 | Goodhart | 166/303 |
| 4,674,579 | A | | 6/1987 | Geller et al. | 175/45 |
| 4,702,314 | A | | 10/1987 | Huang et al. | 166/245 |
| 4,715,440 | A | | 12/1987 | Boxell et al. | 166/100 |
| 4,753,485 | A | * | 6/1988 | Goodhart | 175/61 |
| 4,754,819 | A | | 7/1988 | Dellinger | 175/61 |
| 4,763,734 | A | | 8/1988 | Dickinson et al. | 175/61 |
| 4,830,105 | A | | 5/1989 | Petermann | 166/241 |
| 4,842,081 | A | | 6/1989 | Parant | 175/23 |
| 4,844,182 | A | | 7/1989 | Tolle | 175/215 |
| 4,852,666 | A | | 8/1989 | Brunet et al. | 175/61 |
| 4,957,172 | A | * | 9/1990 | Patton et al. | 175/45 |
| 4,978,172 | A | | 12/1990 | Schwoebel et al. | 299/12 |
| 5,016,710 | A | | 5/1991 | Renard et al. | 166/245 |
| 5,035,605 | A | | 7/1991 | Dinerman et al. | 425/564 |
| 5,036,921 | A | | 8/1991 | Pittard et al. | 166/298 |
| 5,074,360 | A | | 12/1991 | Guinn | 166/281 |
| 5,074,365 | A | | 12/1991 | Kuckes | 175/40 |
| 5,074,366 | A | | 12/1991 | Karlsson et al. | 175/76 |
| 5,103,920 | A | * | 4/1992 | Patton | 175/45 |
| 5,111,893 | A | | 5/1992 | Kvello-Aune | 175/258 |
| 5,121,244 | A | | 6/1992 | Takasaki | 359/161 |
| 5,135,058 | A | | 8/1992 | Millgard et al. | 175/71 |
| 5,148,875 | A | | 9/1992 | Karlsson et al. | 175/62 |
| 5,165,491 | A | | 11/1992 | Wilson | 175/62 |
| 5,168,942 | A | | 12/1992 | Wydrinski | 175/50 |
| 5,174,374 | A | | 12/1992 | Hailey | 166/55.8 |
| 5,193,620 | A | | 3/1993 | Braddick | 166/382 |
| 5,194,859 | A | | 3/1993 | Warren | 340/853.4 |
| 5,194,977 | A | | 3/1993 | Nishio | 359/128 |
| 5,197,553 | A | | 3/1993 | Leturno | 175/57 |
| 5,197,783 | A | | 3/1993 | Theimer et al. | 299/17 |
| 5,199,496 | A | | 4/1993 | Redus et al. | 166/366 |
| 5,201,817 | A | | 4/1993 | Hailey | 175/269 |
| 5,217,076 | A | | 6/1993 | Masek | 166/303 |
| 5,240,350 | A | | 8/1993 | Yamaguchi et al. | 405/143 |
| 5,242,017 | A | | 9/1993 | Hailey | 166/55.8 |
| 5,246,273 | A | | 9/1993 | Rosar | 299/4 |
| 5,255,741 | A | | 10/1993 | Alexander | 166/278 |
| 5,271,472 | A | | 12/1993 | Leturno | 175/107 |
| 5,301,760 | A | | 4/1994 | Graham | 175/61 |
| 5,363,927 | A | | 11/1994 | Frank | 175/67 |
| 5,385,205 | A | | 1/1995 | Hailey | 166/55.8 |
| 5,394,950 | A | | 3/1995 | Gardes | 175/45 |
| 5,402,851 | A | | 4/1995 | Baiton | 166/369 |
| 5,411,082 | A | | 5/1995 | Kennedy | 166/181 |
| 5,411,085 | A | | 5/1995 | Moore et al. | 166/242 |
| 5,411,104 | A | | 5/1995 | Stanley | 175/65 |
| 5,431,220 | A | | 7/1995 | Lennon et al. | 166/55.7 |
| 5,435,400 | A | | 7/1995 | Smith | 175/61 |
| 5,450,902 | A | | 9/1995 | Matthews | 166/268 |
| 5,454,419 | A | | 10/1995 | Vloedman | 166/277 |
| 5,462,116 | A | | 10/1995 | Carroll | 166/249 |
| 5,462,120 | A | | 10/1995 | Gondouin | 166/380 |
| 5,469,155 | A | | 11/1995 | Archambeault et al. | 340/853.4 |
| 5,477,923 | A | | 12/1995 | Jordan, Jr. et al. | 166/313 |
| 5,485,089 | A | | 1/1996 | Kuckes | 324/346 |
| 5,494,121 | A | | 2/1996 | Nackerud | 175/263 |
| 5,501,273 | A | | 3/1996 | Puri | 166/252.5 |
| 5,501,279 | A | | 3/1996 | Garg et al. | 166/372 |
| 5,584,605 | A | | 12/1996 | Beard et al. | 405/128 |
| 5,615,739 | A | | 4/1997 | Dallas | 166/306 |
| 5,659,347 | A | | 8/1997 | Taylor | 347/85 |
| 5,669,444 | A | | 9/1997 | Riese et al. | 166/263 |
| 5,680,901 | A | | 10/1997 | Gardes | 166/313 |
| 5,690,390 | A | | 11/1997 | Bithell | 299/4 |
| 5,706,871 | A | | 1/1998 | Andersson et al. | 141/59 |
| 5,720,356 | A | | 2/1998 | Gardes | 175/62 |
| 5,727,629 | A | | 3/1998 | Blizzard, Jr. et al. | 166/298 |
| 5,735,350 | A | | 4/1998 | Longbottom et al. | 166/313 |
| 5,785,133 | A | | 7/1998 | Murray et al. | 175/61 |
| 5,832,958 | A | | 11/1998 | Cheng | 137/625.41 |
| 5,852,505 | A | | 12/1998 | Li | 359/118 |
| 5,853,054 | A | | 12/1998 | McGarian et al. | 175/267 |
| 5,853,056 | A | | 12/1998 | Landers | 175/424 |
| 5,863,283 | A | | 1/1999 | Gardes | 588/250 |
| 5,867,289 | A | | 2/1999 | Gerstel et al. | 359/110 |
| 5,868,202 | A | | 2/1999 | Hsu | 166/256 |

| | | | | |
|---|---|---|---|---|
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,912,754 | A | 6/1999 | Koga et al. | 359/179 |
| 5,914,798 | A | 6/1999 | Liu | 359/161 |
| 5,917,325 | A | 6/1999 | Smith | 324/326 |
| 5,934,390 | A | 8/1999 | Uthe | 175/67 |
| 5,957,539 | A | 9/1999 | Durup et al. | 299/4 |
| 6,024,171 | A | 2/2000 | Montgomery et al. | 166/308 |
| 6,065,550 | A | 5/2000 | Gardes | 175/62 |
| 6,119,771 | A | 9/2000 | Gano et al. | 166/50 |
| 6,135,208 | A | 10/2000 | Gano et al. | 166/313 |
| 6,279,658 | B1 * | 8/2001 | Donovan et al. | 166/205.15 |
| 6,280,000 | B1 | 8/2001 | Zupanick | 299/12 |

OTHER PUBLICATIONS

Pend Pat App, Joseph A. Zupanick et al., "*Method and System for Management of By–Products From Subterranean Zones*," SN 10/046001, Oct. 19, 2001.

Pend Pat App, Joseph A. Zupanick, "*Method and System for Accessing Subterranean Deposits From The Surface*," SN 09/885,219, Jun. 20, 2001.

Nackerud Product Description.

Joseph A. Zupanick; Declaration of Experimental Use with attached exhibits A–D, pp. 1–3, Nov. 14, 2000.

Howard L. Hartman, et al.; "*SME Mining Engineering Handbook*;" Society for Mining, Metallurgy, and Exploration, Inc, pp. 1946–1950, 2nd Edition, vol. 2, 1992.

Dave Hassan, Mike Chernichen, Earl Jensen, and Morley Frank; "Multi–lateral technique lowers drilling costs, provides environmental benefits", Drilling Technology, pp. 41–47, Oct. 1999.

Pending Patent Application, Joseph A. Zupanick, "*Method for Production of Gas From a Coal Seam*," Ser. No. 09/197,687, Filed Nov. 20, 1998.

Pending Patent Application, Joseph A. Zupanick, "*Method and System for Accessing Subterranean Deposits From The Surface*," Ser. No. 09/444,029, Filed Nov. 19, 1999.

Pending Patent Application, Joseph A. Zupanick, "*Method and System for Accessing Subterranean Deposits From The Surface*," Ser. No. 09/789,956, Filed Feb. 20, 1999.

Pending Patent Application, Joseph A. Zupanick, "*Method and System for Accessing Subterranean Deposits From The Surface*," Ser. No. 09/788,897, Filed Feb. 20, 2001.

Pending Patent Application, Joseph A. Zupanick, "*Method and System for Accessing Subterranean Deposits From The Surface*," Ser. No. 09/791,033, Filed Feb. 20, 2001.

Pending Patent Application, Joseph A. Zupanick,*Cavity Well Positioning system and Method*, Ser. No. 09/696,338, Oct. 24, 2000.

Pending Patent Application, Joseph A. Zupanick, *Method and System for Enhanced Access to a Subterrean Zone*, Ser. No. 09/769,098, Jan. 24, 2001.

Pending Patent Application, Joseph A. Zupanick, *Method and System for Accessing a Subterrean Zone from a Limited Surface Area*, Ser. No. 09/774,996, Jan. 30, 2001.

McCray and Cole, "*Oil Well Drilling and Technology*," University of Oklahoma Press, pp. 315–319, 1959.

Berger and Anderson, "*Modern Petroleum*;" Penn Well Books, pp. 106–108, 1978.

* cited by examiner

METHOD AND SYSTEM FOR ACCESSING SUBTERRANEAN ZONES FROM A LIMITED SURFACE AREA

TECHNICAL FIELD OF THE INVENTION

The present invention relates generally to the field of subterranean exploration and drilling and, more particularly, to a method and system for accessing subterranean zones from a limited surface area.

BACKGROUND OF THE INVENTION

Subterranean deposits of coal, whether of "hard" coal such as anthracite or "soft" coal such as lignite or bituminous coal, contain substantial quantities of entrained methane gas. Limited production and use of methane gas from coal deposits has occurred for many years. Substantial obstacles have frustrated more extensive development and use of methane gas deposits in coal seams. The foremost problem in producing methane gas from coal seams is that while coal seams may extend over large areas, up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seam exposed to a drill bore for gas extraction. Traditional horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

Prior mining systems also generally require a fairly large and level surface area from which to work. As a result, prior mining systems and drilling technologies generally cannot be used in Appalachia or other hilly terrains. For example, in some areas the largest area of flat land may be a wide roadway. Thus, less effective methods must be used, leading to production delays that add to the expense associated with degasifying a coal seam.

SUMMARY OF THE INVENTION

The present invention provides a method and system for accessing subterranean zones from a limited surface area that substantially eliminates or reduces the disadvantages and problems associated with previous systems and methods. In particular, from a common bore an articulated well bore with a well bore pattern in a subterranean seam extends from or proximate to a cavity well in communication with the well bore pattern in the seam. The well bore patterns provide access to a large subterranean area while the cavity well allows entrained water, hydrocarbons, and other a deposits collected by the well bore pattern to be efficiently removed and/or produced. The well bore pattern also provides access to the subterranean zone for treating material within the subterranean zone or introducing or injecting a substance into the subterranean zone.

In accordance with one embodiment of the present invention, a system for extracting resources from a subsurface formation includes a substantially vertical well bore extending from the surface to a target zone. The system also includes an articulated well bore extending from the substantially vertical well bore to the target zone. The articulated well bore diverges from the substantially vertical well bore between the surface and the target zone. The system also includes a drainage pattern extending from the articulated well bore in the target zone and operable to collect resources from the target zone. The system further includes a subsurface channel operable to communicate resources from the drainage pattern to the substantially vertical well bore. The system also includes a vertical pump disposed in the substantially vertical well bore and operable to lift resources collected in the substantially vertical well bore to the surface.

In accordance with another aspect of the present invention, the substantially horizontal drainage pattern may comprise a pinnate pattern including a substantially horizontal diagonal well bore extending from the substantially vertical well bore that defines a first end of an area covered by the drainage pattern to a distant end of the area. A first set of substantially horizontal lateral well bores extend in a spaced apart relationship relative to each other from the diagonal well bore to the periphery of the area on a first side of the diagonal well bore. A second set of substantially horizontal lateral well bores extend in a spaced apart relationship relative to each other from the diagonal well bore to the periphery of the area on a side of the diagonal opposite the first set. One or more of the substantially horizontal lateral well bores may further comprise a curved or radiused portion proximate to the diagonal well bore.

Technical advantages of the present invention include providing an improved method and system for accessing subterranean deposits from a limited area on the surface. In particular, a well bore pattern is drilled in a target zone from an articulated surface well at least in close proximity to a cavity well. The well bore pattern is interconnected to the cavity well by a channel through which entrained water, hydrocarbons, and other fluids may be drained from the target zone and efficiently removed and/or produced by a rod pumping unit. As a result, gas, oil, and other fluids from a large, low pressure or low porosity formation can be efficiently produced at a limited area on the surface. Thus, gas may be recovered from formations underlying rough topology. In addition, environmental impact is minimized as the area to be cleared and used is minimized.

Another technical advantage of the present invention includes providing an improved well bore pattern for accessing an increased area of a subterranean zone. In particular, a pinnate well bore structure with a main well bore and opposed laterals is used to maximize access to a subterranean zone from a single well bore. Length of the laterals is maximized proximate to an articulated well bore used to form the well bore pattern and decreases toward the end of the main well bore to provide uniform access to a quadrilateral or other grid area. The first set of laterals proximate to the articulated well bore may comprise a curved or radiused portion proximate to the main well bore, allowing greater spacing between the laterals and, therefore, greater coverage of the subterranean zone. This allows the well bore pattern to be aligned with longwall panels and other subsurface structures for more efficient degasification of a mine coal seam or other deposit.

Yet another technical advantage of the present invention includes providing an improved method and system for preparing a coal seam or other subterranean deposit for mining and for collecting gas from the seam after mining operations. In particular, a surface well, with a vertical portion, an articulated portion, and a cavity, is used to degasify a coal seam prior to mining operations. This reduces both needed surface area and underground equipment and activities. This also reduces the time needed to degasify the seam, which minimizes shutdowns due to high gas content. In addition, water and additives may be pumped into the degasified coal seam through the combined well prior to mining operations to minimize dust and other hazardous conditions, to improve efficiency of the mining process, and to improve the quality of the coal product. After mining, the combined well is used to collect gob gas. As a result, costs associated with the collection of gob gas are minimized to facilitate or make feasible the collection of gob gas from previously mined seams.

Still another technical advantage of the present invention includes an improved method and system for accessing multiple subterranean deposits from a limited area on the surface. In particular, a first well bore pattern is drilled in a first target zone from a first articulated surface well in close proximity to a cavity well bore. The first well bore pattern is interconnected to the first cavity well bore by a first channel. A second well bore pattern is drilled in a second target zone from a second articulated surface well in close proximity to the cavity well. The second well bore pattern is interconnected to the cavity well by a second channel. As a result, multiple subterranean formations may be accessed from a limited area on the surface. For example, gas may be recovered from multiple formations underlying rough topology. In addition, environmental impact is minimized as the area to be cleared and used is minimized. Furthermore, overall drilling time is minimized as multiple drainage patterns are drilled while the drilling equipment is still on site, eliminating the need to take down and set up the drilling equipment more than once.

In another embodiment of the present invention, an articulated well bore and cavity well bore each extend from a surface location generally within 100 feet or less of each other, minimizing the surface area needed for production and drilling equipment. In one embodiment, the articulated well bore and the cavity well bore comprise a common portion at or near the surface. A well casing extends from the surface to the end of the common portion distal to the surface. As a result, the cavity and articulated well bores can be formed from a roadway, steep hillside, or other limited surface area. When the articulated and cavity well bores comprise a common portion, all drilling equipment may be located within a 100 square foot area on the surface. Accordingly, environmental impact is minimized as less surface area must be cleared.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
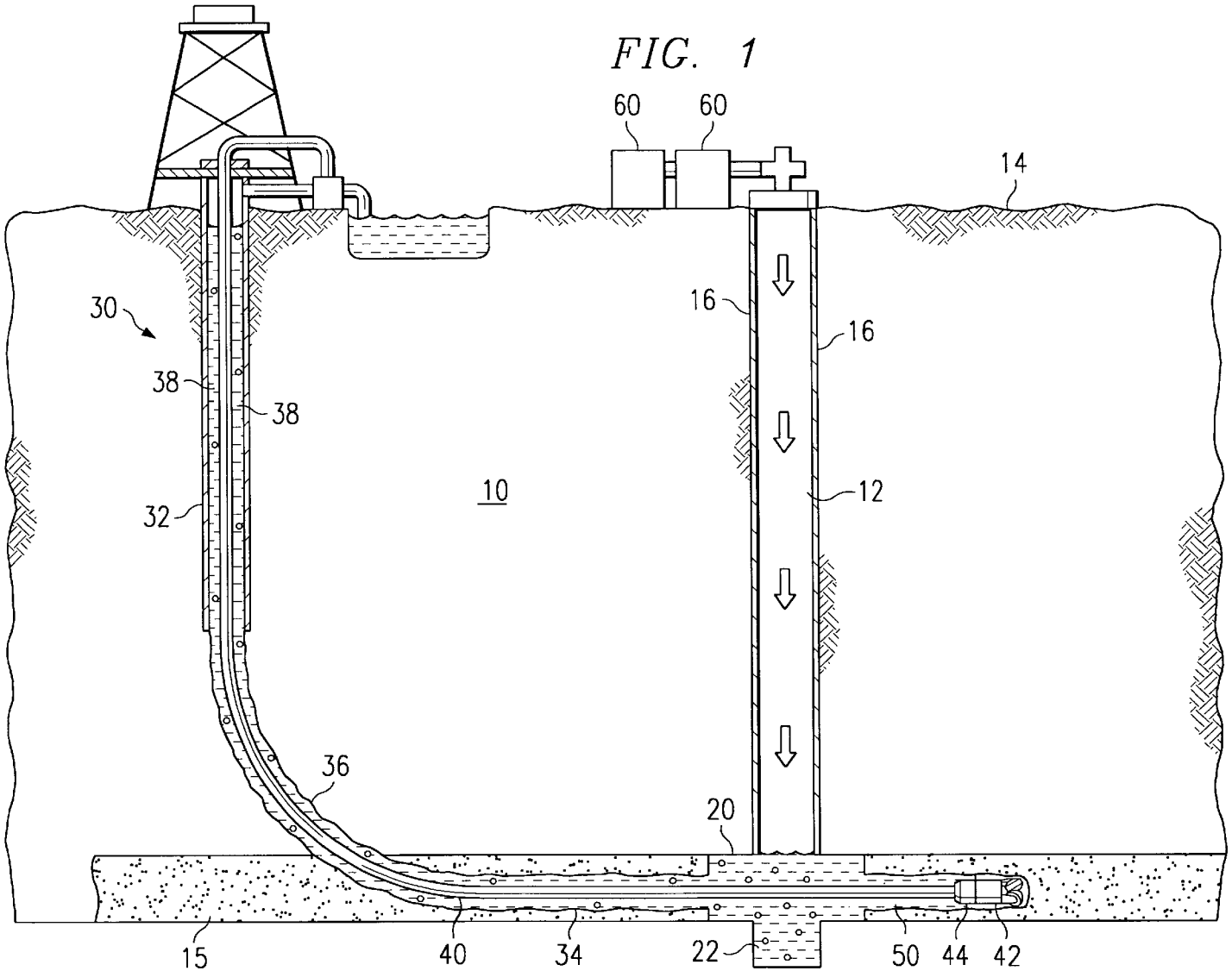
FIG. 1 is a cross-sectional diagram illustrating formation of a well bore pattern in a subterranean zone through an articulated surface well intersecting a cavity well in accordance with one embodiment of the present invention.

FIG. 1 illustrates a cavity and articulated well combination for accessing a subterranean zone from the surface in accordance with one embodiment of the present invention. In this embodiment, the subterranean zone is a coal seam. It will be understood that other subterranean formations and/or other low pressure, ultra-low pressure, and low porosity subterranean zones can be similarly accessed using the dual radius well system of the present invention to remove and/or produce water, hydrocarbons and other fluids in the zone, to treat minerals in the zone prior to mining operations, or to inject or introduce fluids, gases or other substances into the zone.

Referring to FIG. 1, a well bore 12 extends from the surface 14 to a target coal seam 15. The well bore 12 intersects, penetrates and continues below the coal seam 15. The well bore 12 may be lined with a suitable well casing 16 that terminates at or above the upper level of the coal seam 15. In FIGS. 1–3 and 8, well bore 12 is illustrated substantially vertical; however, it should be understood that well bore 12 may be formed at any suitable angle relative to the surface 14 to accommodate, for example, surface 14 geometries and attitudes and/or the geometric configuration or attitude of a subterranean resource.

The well bore 12 is logged either during or after drilling in order to locate the exact vertical depth of the coal seam 15. As a result, the coal seam is not missed in subsequent drilling operations, and techniques used to locate the seam 15 while drilling need not be employed. An enlarged cavity 20 is formed in the well bore 12 at the level of the coal seam 15. As described in more detail below, the enlarged cavity 20 provides a junction for intersection of the well bore 12 by an articulated well bore used to form a subterranean well bore pattern in the coal seam 15. The enlarged cavity 20 also provides a collection point for fluids drained from the coal seam 15 during production operations.

In one embodiment, the enlarged cavity 20 has a radius of approximately eight feet and a vertical dimension which equals or exceeds the vertical dimension of the coal seam 15. The enlarged cavity 20 is formed using suitable under-reaming techniques and equipment. A portion of the well bore 12 continues below the enlarged cavity 20 to form a sump 22 for the cavity 20.

An articulated well bore 30 extends from the surface 14 to the enlarged cavity 20 of the well bore 12. The articulated well bore 30 includes a portion 32, a portion 34, and a curved or radiused portion 36 interconnecting the portions 32 and 34. In FIG. 1, the portion 32 is illustrated substantially vertical; however it should be understood that portion 32 may be formed at any suitable angle relative to the surface 14 to accommodate surface 14 geometric characteristics and attitudes and/or the geometric configuration or attitude of the coal seam 15. The portion 34 lies substantially in the plane of the coal seam 15 and intersects the large diameter cavity 20 of the well bore 12. In FIG. 1, the plane of the coal seam 15 is illustrated substantially horizontal, thereby resulting in a substantially horizontal portion 34; however, it should be understood that portion 34 may be formed at any suitable angle relative to the surface 14 to accommodate the geometric characteristics of the coal seam 15.

In the illustrated embodiment, the articulated well bore 30 is offset a sufficient distance from the well bore 12 at the surface 14 to permit the large radius curved portion 36 and any desired portion 34 to be drilled before intersecting the enlarged cavity 20. In one embodiment, to provide the curved portion 36 with a radius of 100–150 feet, the articulated well bore 30 is offset a distance of about 300 feet from the well bore 12. This spacing minimizes the angle of the curved portion 36 to reduce friction in the bore 30 during drilling operations. As a result, reach of the articulated drill string drilled through the articulated well bore 30 is maximized. As discussed below, another embodiment of the present invention includes locating the articulated well bore 30 significantly closer to the well bore 12 at the surface 14.

The articulated well bore 30 is drilled using articulated drill string 40 that includes a suitable down-hole motor and bit 42. A measurement while drilling (MWD) device 44 is included in the articulated drill string 40 for controlling the orientation and direction of the well bore drilled by the motor and bit 42. The portion 32 of the articulated well bore 30 may be lined with a suitable casing 38.

After the enlarged cavity 20 has been successfully intersected by the articulated well bore 30, drilling is continued through the cavity 20 using the articulated drill string 40 and appropriate drilling apparatus to provide a subterranean well bore pattern 50 in the coal seam 15. In FIG. 1, the well bore pattern 50 is illustrated substantially horizontal corresponding to a substantially horizontally illustrated coal seam 15; however, it should be understood that well bore pattern 50 may be formed at any suitable angle corresponding to the geometric characteristics of the coal seam 15. The well bore pattern 50 and other such well bores include sloped, undulating, or other inclinations of the coal seam 15 or other subterranean zone. During this operation, gamma ray logging tools and conventional measurement while drilling devices may be employed to control and direct the orientation of the drill bit 42 to retain the well bore pattern 50 within the confines of the coal seam 15 and to provide substantially uniform coverage of a desired area within the coal seam 15. Further information regarding the well bore pattern is described in more detail below in connection with FIGS. 4–7 and 12.

During the process of drilling the well bore pattern 50, drilling fluid or "mud" is pumped down the articulated drill string 40 and circulated out of the drill string 40 in the vicinity of the bit 42, where it is used to scour the formation and to remove formation cuttings. The cuttings are then entrained in the drilling fluid which circulates up through the annulus between the drill string 40 and the walls of well bore 30 until it reaches the surface 14, where the cuttings are removed from the drilling fluid and the fluid is then recirculated. This conventional drilling operation produces a standard column of drilling fluid having a vertical height equal to the depth of the well bore 30 and produces a hydrostatic pressure on the well bore corresponding to the well bore depth. Because coal seams tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an "over-balanced" drilling operation in which the hydrostatic fluid pressure in the well bore exceeds the ability of the formation to withstand the pressure. Loss of drilling fluids and cuttings into the formation not only is expensive in terms of the lost drilling fluids, which must be made up, but it also tends to plug the pores in the coal seam 15, which are needed to drain the coal seam of gas and water.

To prevent over-balance drilling conditions during formation of the well bore pattern 50, air compressors 60 are provided to circulate compressed air down the well bore 12 and back up through the articulated well bore 30. The circulated air will admix with the drilling fluids in the annulus around the articulated drill string 40 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid reduces down-hole pressure to approximately 150–200 pounds per square inch (psi). Accordingly, low pressure coal seams and other subterranean zones can be drilled without substantial loss of drilling fluid and contamination of the zone by the drilling fluid.

Foam, which may be compressed air mixed with water, may also be circulated down through the articulated drill string 40 along with the drilling mud in order to aerate the drilling fluid in the annulus as the articulated well bore 30 is being drilled and, if desired, as the well bore pattern 50 is being drilled. Drilling of the well bore pattern 50 with the use of an air hammer bit or an air-powered down-hole motor will also supply compressed air or foam to the drilling fluid. In this case, the compressed air or foam which is used to power the down-hole motor and bit 42 exits the articulated drill string 40 in the vicinity of the drill bit 42. However, the larger volume of air which can be circulated down the well bore 12 permits greater aeration of the drilling fluid than generally is possible by air supplied through the articulated drill string 40.

Figure 2:
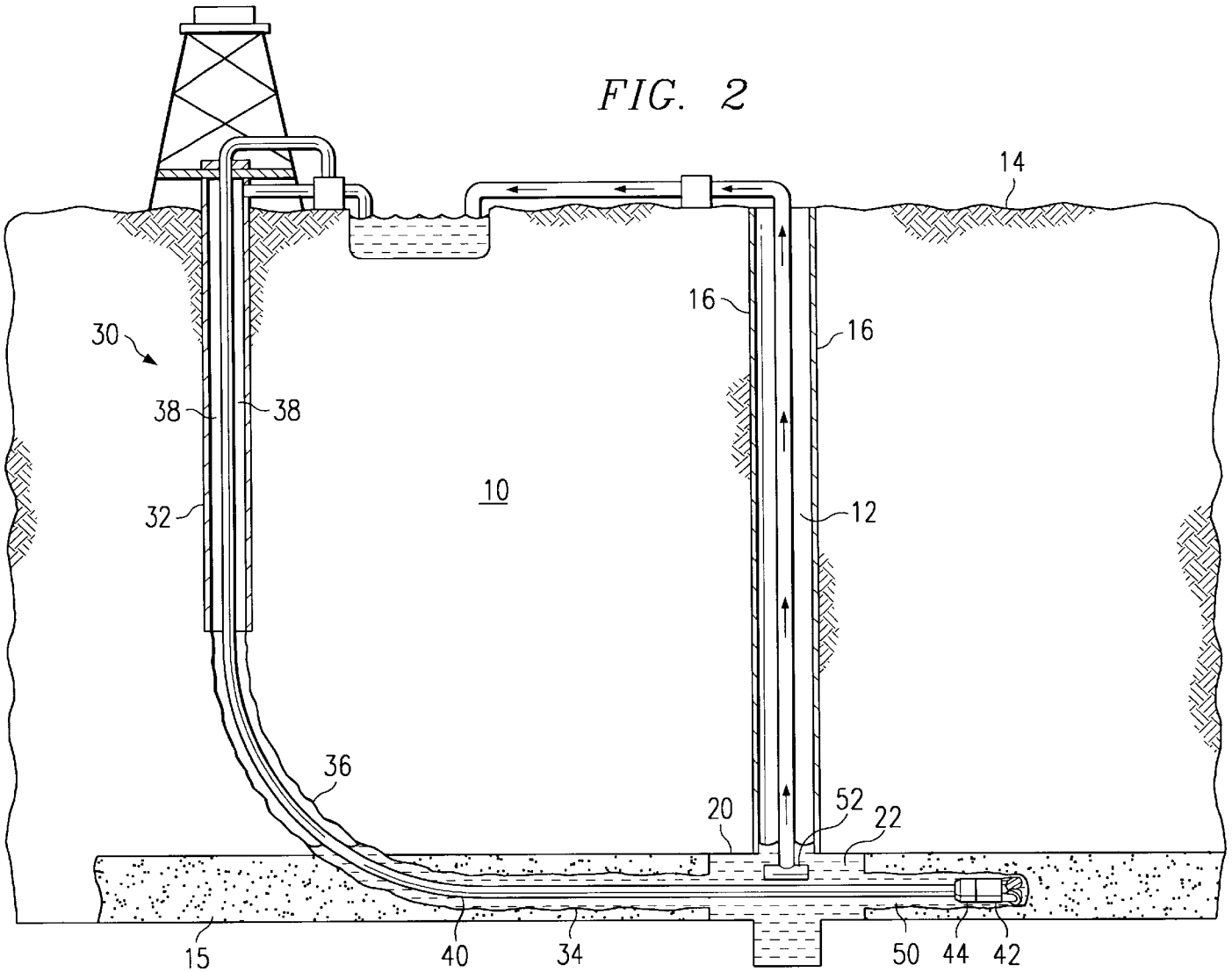
FIG. 2 is a cross-sectional diagram illustrating formation of the well bore pattern in the subterranean zone through the articulated surface well intersecting the cavity well in accordance with another embodiment of the present invention.

FIG. 2 illustrates a method and system for drilling the well bore pattern 50 in the coal seam 15 in accordance with another embodiment of the present invention. In this embodiment, the well bore 12, enlarged cavity 20 and articulated well bore 30 are positioned and formed as previously described in connection with FIG. 1.

Referring to FIG. 2, after intersection of the enlarged cavity 20 by the articulated well bore 30, a pump 52 is installed in the enlarged cavity 20 to pump drilling fluid and cuttings to the surface 14 through the well bore 12. This eliminates the friction of air and fluid returning up the articulated well bore 30 and reduces down-hole pressure to nearly zero. Accordingly, coal seams and other subterranean zones having ultra low pressures, such as below 150 psi, can be accessed from the surface. Additionally, the risk of combining air and methane in the well is substantially eliminated.

Figure 3:
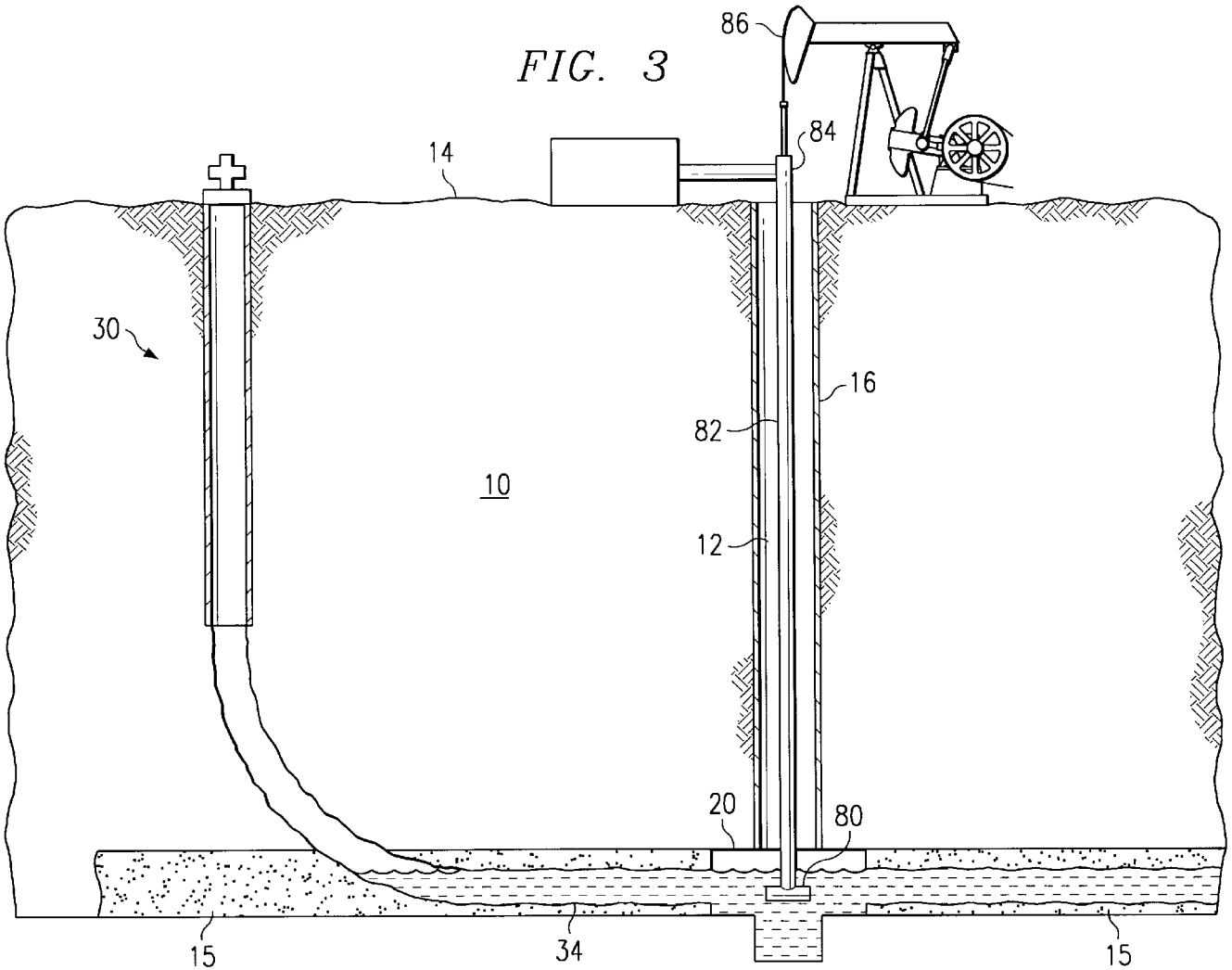
FIG. 3 is a cross-sectional diagram illustrating production of fluids from a well bore pattern in a subterranean zone through a well bore in accordance with one embodiment of the present invention.

FIG. 3 illustrates production of fluids from the well bore pattern 50 in the coal seam 15 in accordance with one embodiment of the present invention. In this embodiment, after the well bores 12 and 30, respectively, as well as desired well bore pattern 50, have been drilled, the articulated drill string 40 is removed from the articulated well bore 30 and the articulated well bore 30 is capped. For multiple pinnate structures described below, the articulated well bore 30 may be plugged in the portion 34. Otherwise, the articulated well 30 may be left unplugged.

Referring to FIG. 3, a down hole pump 80 is disposed in the well bore 12 in the enlarged cavity 20. The enlarged cavity 20 provides a reservoir for accumulated fluids allowing intermittent pumping without adverse effects of a hydrostatic head caused by accumulated fluids in the well bore. The enlarged cavity 20 also provides a reservoir for water separation for fluids accumulated from the well bore pattern 50.

The down hole pump 80 is connected to the surface 14 via a tubing string 82 and may be powered by sucker rods 84 extending down through the well bore 12 of the tubing string 82. The sucker rods 84 are reciprocated by a suitable surface mounted apparatus, such as a powered walking beam 86 to operate the down hole pump 80. The down hole pump 80 is used to remove water and entrained coal fines from the coal seam 15 via the well bore pattern 50. Once the water is removed to the surface, it may be treated for separation of methane which may be dissolved in the water and for removal of entrained fines. After sufficient water has been removed from the coal seam 15, pure coal seam gas may be allowed to flow to the surface 14 through the annulus of the well bore 12 around the tubing string 82 and removed via piping attached to a wellhead apparatus. At the surface 14, the methane is treated, compressed and pumped through a pipeline for use as a fuel in a conventional manner. The down hole pump 80 may be operated continuously or as needed to remove water drained from the coal seam 15 into the enlarged cavity 22.

FIGS. 4–7 illustrate well bore patterns 50 for accessing the coal seam 15 or other subterranean zone in accordance with one embodiment of the present invention. In this embodiment, the well bore patterns 50 comprise pinnate well bore patterns that have a central diagonal with generally symmetrically arranged and appropriately spaced laterals extending from each side of the diagonal. The pinnate pattern approximates the pattern of veins in a leaf or the design of a feather in that it has similar, substantially parallel, auxiliary drainage bores arranged in substantially equal and parallel spacing on opposite sides of an axis. The pinnate drainage pattern with its central bore and generally symmetrically arranged and appropriately spaced auxiliary drainage bores on each side provides a uniform pattern for draining fluids from a coal seam or other subterranean formation. As described in more detail below, the pinnate pattern provides substantially uniform coverage of a square, other quadrilateral, or grid area and may be aligned with longwall mining panels for preparing the coal seam 15 for mining operations. It will be understood that other suitable well bore patterns may be used in accordance with the present invention.

The pinnate and other suitable well bore patterns 50 drilled from the surface 14 provide surface access to subterranean formations. The well bore pattern 50 may be used to uniformly remove and/or insert fluids or otherwise manipulate a subterranean deposit. In non-coal applications, the well bore pattern 50 may be used initiating in-situ burns, "huff-puff" steam operations for heavy crude oil, and the removal of hydrocarbons from low porosity reservoirs. The well bore pattern 50 may also be used to uniformly inject or introduce a gas, fluid or other substance into a subterranean zone.

Figure 4:
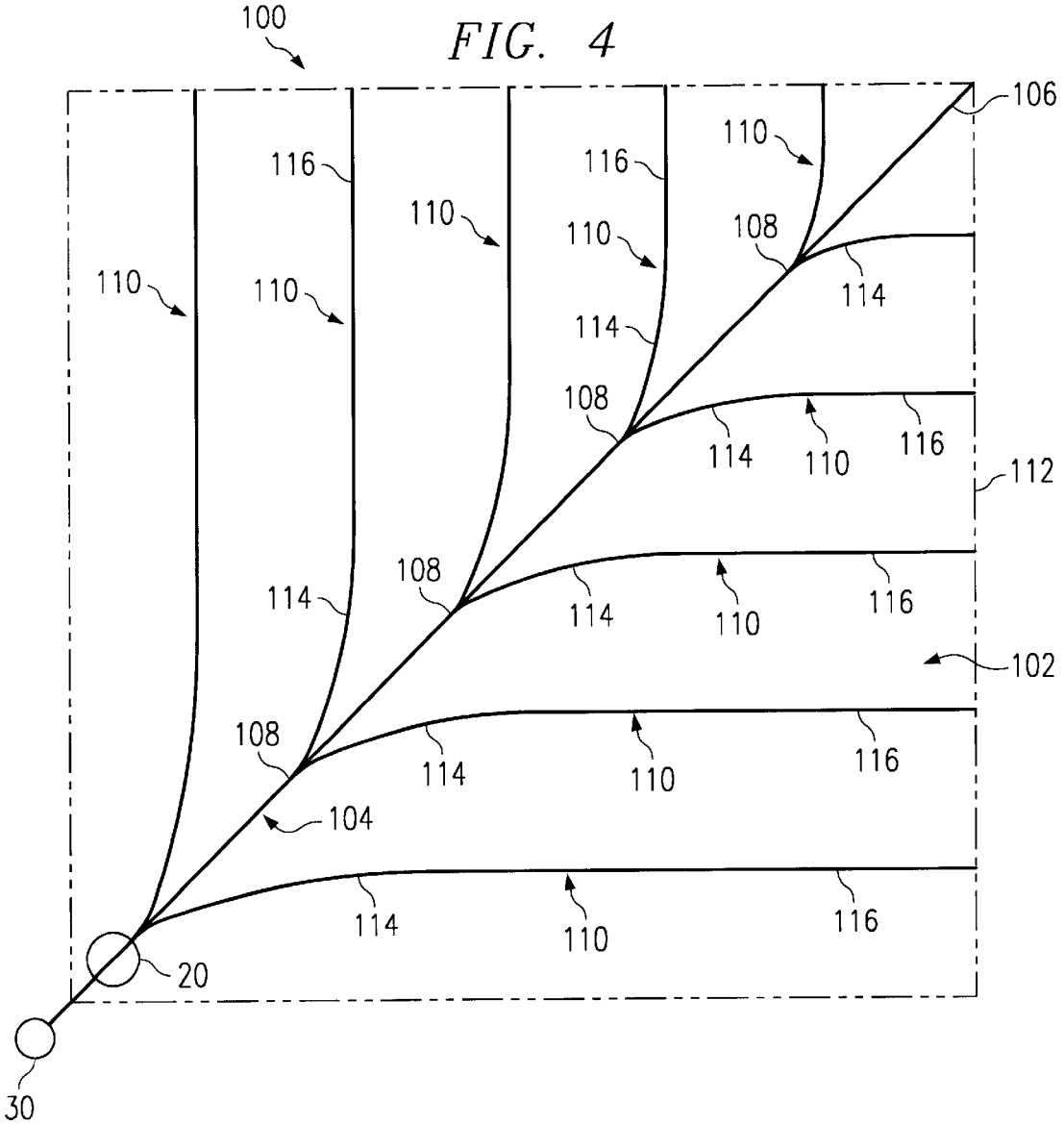
FIG. 4 is a top plan diagram illustrating a pinnate well bore pattern for accessing a subterranean zone in accordance with one embodiment of the present invention.

FIG. 4 illustrates a pinnate well bore pattern 100 in accordance with one embodiment of the present invention. In this embodiment, the pinnate well bore pattern 100 provides access to a substantially square area 102 of a subterranean zone. A number of the pinnate well bore patterns 100 may be used together to provide uniform access to a large subterranean region.

Referring to FIG. 4, the enlarged cavity 20 defines a first corner of the area 102. The pinnate pattern 100 includes a main well bore 104 extending diagonally across the area 102 to a distant corner 106 of the area 102. Preferably, the well bores 12 and 30 are positioned over the area 102 such that the main well bore 104 is drilled up the slope of the coal seam 15. This will facilitate collection of water, gas, and other fluids from the area 102. The well bore 104 is drilled using the articulated drill string 40 and extends from the enlarged cavity 20 in alignment with the articulated well bore 30.

A plurality of lateral well bores 110 extend from opposites sides of well bore 104 to a periphery 112 of the area 102. The lateral bores 110 may mirror each other on opposite sides of the well bore 104 or may be offset from each other along the well bore 104. Each of the lateral bores 110 includes a radius curving portion 114 extending from the well bore 104 and an elongated portion 116 formed after the curved portion 114 has reached a desired orientation. For uniform coverage of the square area 102, pairs of lateral bores 110 are substantially evenly spaced on each side of the well bore 104 and extend from the well bore 104 at an angle of approximately 45 degrees. The lateral bores 110 shorten in length based on progression away from the enlarged cavity 20 in order to facilitate drilling of the lateral bores 110.

The pinnate well bore pattern 100 using a single well bore 104 and five pairs of lateral bores 110 may drain a coal seam area of approximately 150 acres in size. Where a smaller area is to be drained, or where the coal seam has a different shape, such as a long, narrow shape, other shapes or due to surface or subterranean topography, alternate pinnate well bore patterns may be employed by varying the angle of the lateral bores 110 to the well bore 104 and the orientation of the lateral bores 110. Alternatively, lateral bores 110 can be drilled from only one side of the well bore 104 to form a one-half pinnate pattern.

The well bore 104 and the lateral bores 110 are formed by drilling through the enlarged cavity 20 using the articulated drill string 40 and an appropriate drilling apparatus. During this operation, gamma ray logging tools and conventional measurement while drilling (MWD) technologies may be employed to control the direction and orientation of the drill bit so as to retain the well bore pattern within the confines of the coal seam 15 and to maintain proper spacing and orientation of the well bores 104 and 110.

In a particular embodiment, the well bore 104 is drilled with an incline at each of a plurality of lateral kick-off points 108. After the well bore 104 is complete, the articulated drill string 40 is backed up to each successive lateral point 108 from which a lateral bore 110 is drilled on each side of the well bore 104. It will be understood that the pinnate drainage pattern 100 may be otherwise suitably formed in accordance with the present invention.

Figure 5:
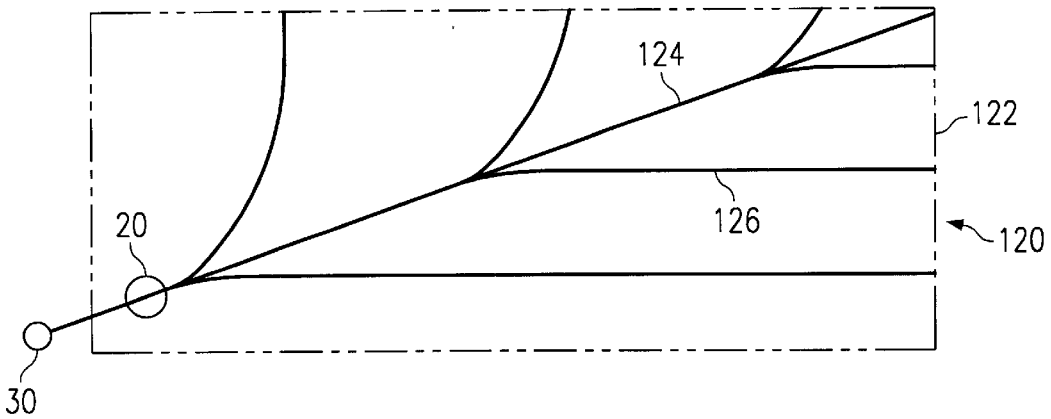
FIG. 5 is a top plan diagram illustrating a pinnate well bore pattern for accessing a subterranean zone in accordance with another embodiment of the present invention.

FIG. 5 illustrates a pinnate well bore pattern 120 in accordance with another embodiment of the present invention. In this embodiment, the pinnate well bore pattern 120 drains a substantially rectangular area 122 of the coal seam 15. The pinnate well bore pattern 120 includes a main well bore 124 and a plurality of lateral bores 126 that are formed as described in connection with well bores 104 and 110 of FIG. 4. For the substantially rectangular area 122, however, the lateral well bores 126 on a first side of the well bore 124 include a shallow angle while the lateral bores 126 on the opposite side of the well bore 124 include a steeper angle to together provide uniform coverage of the area 122.

Figure 6:
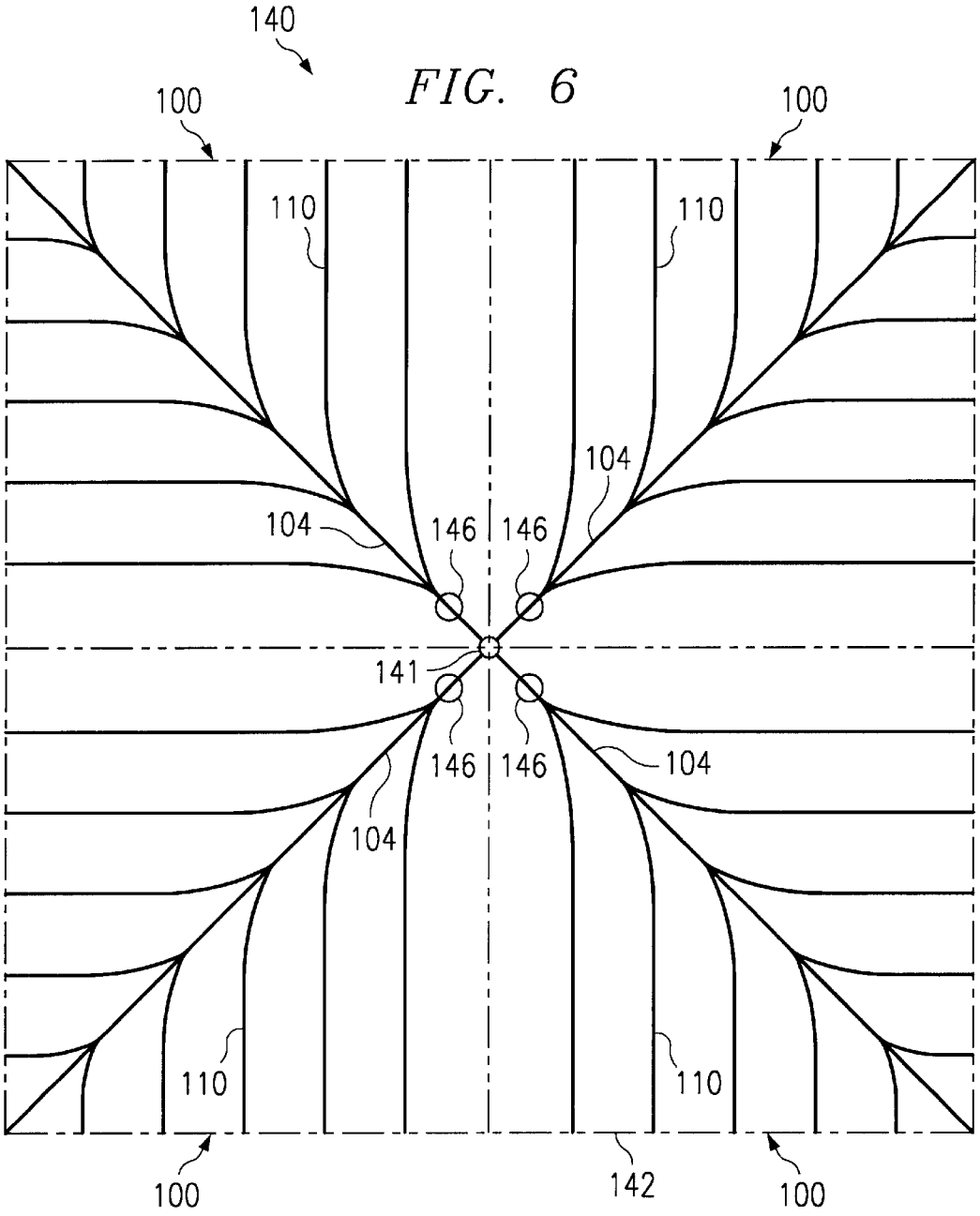
FIG. 6 is a top plan diagram illustrating a quadrilateral pinnate well bore pattern for accessing a subterranean zone in accordance with still another embodiment of the present invention.

FIG. 6 illustrates a quadrilateral pinnate well bore pattern 140 in accordance with another embodiment of the present invention. The quadrilateral well bore pattern 140 includes four discrete pinnate well bore patterns 100 each used to access a quadrant of a region 142 covered by the pinnate well bore pattern 140.

Each of the pinnate well bore patterns 100 includes a well bore 104 and a plurality of lateral well bores 110 extending from the well bore 104. In the quadrilateral embodiment, each of the well bores 104 and 110 is drilled from a common articulated well bore 141. This allows tighter spacing of the surface production equipment, wider coverage of a well bore pattern, and reduces drilling equipment and operations.

Figure 7:
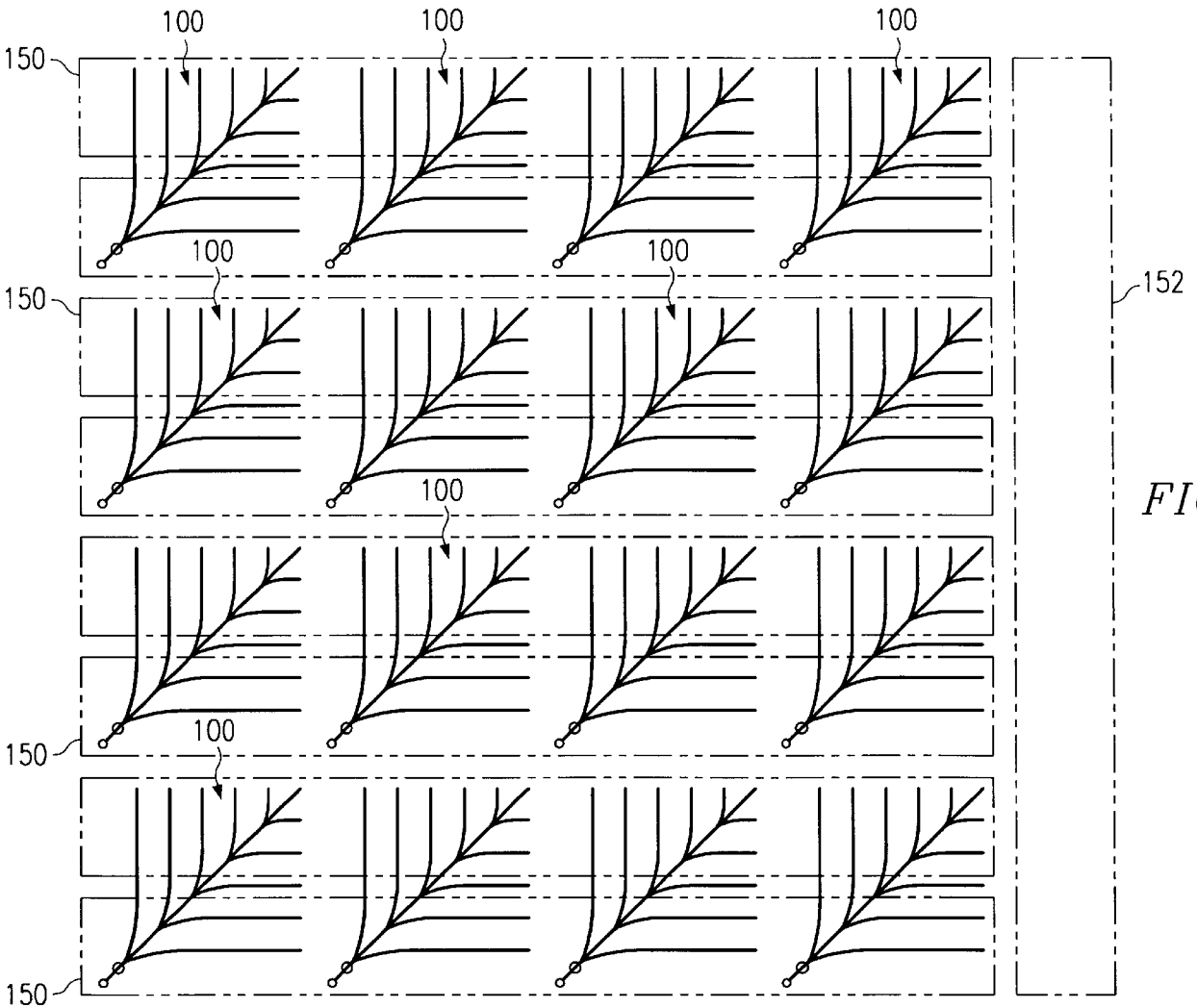
FIG. 7 is a top plan diagram illustrating the alignment of pinnate well bore patterns within panels of a coal seam for degasifying and preparing the coal seam for mining operations in accordance with one embodiment of the present invention.

FIG. 7 illustrates the alignment of pinnate well bore patterns 100 with subterranean structures of a coal seam 15 for degasifying and preparing the coal seam 15 for mining operations in accordance with one embodiment of the present invention. In this embodiment, the coal seam 15 is mined using a longwall process. It will be understood that the present invention can be used to degasify coal seams for other types of mining operations.

Referring to FIG. 7, coal panels 150 extend longitudinally from a longwall 152. In accordance with longwall mining practices, each panel 150 is subsequently mined from a distant end toward the longwall 152 and the mine roof allowed to cave and fracture into the opening behind the mining process. Prior to mining of the panels 150, the pinnate well bore patterns 100 are drilled into the panels 150 from the surface to degasify the panels 150 well ahead of mining operations. Each of the pinnate well bore patterns 100 is aligned with the longwall 152 and panel 150 grid and covers portions of one or more panels 150. In this way, a region of a mine can be degasified from the surface based on subterranean structures and constraints, allowing a subsurface formation to be degasified and mined at the same time.

Figure 8:
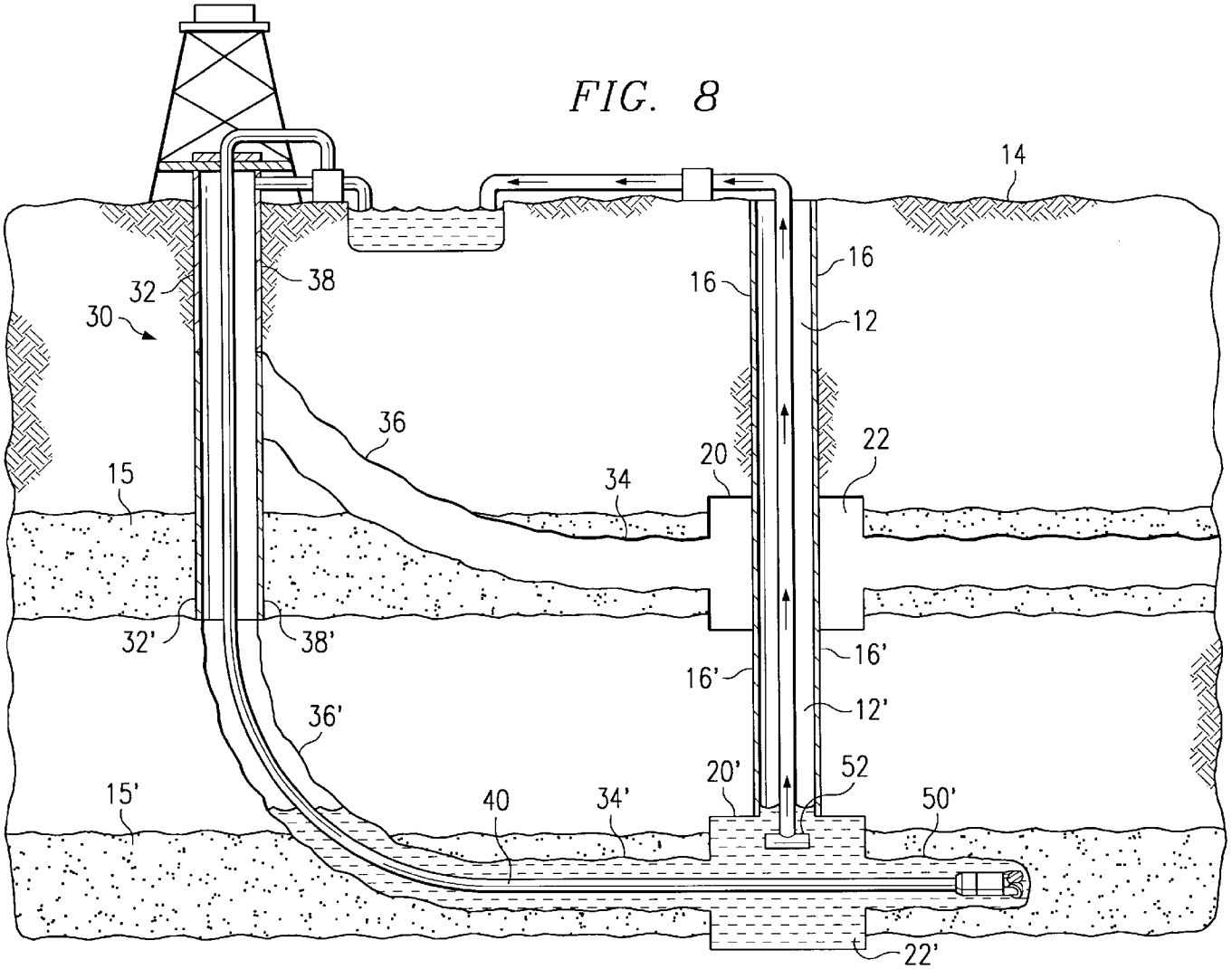
FIG. 8 is a cross-sectional diagram illustrating production of fluids from well bore patterns in dual subterranean zones through a well bore in accordance with another embodiment of the present invention.

FIG. 8 illustrates a method and system for drilling the well bore pattern 50 in a second subterranean zone, located below the coal seam 15, in accordance with another embodiment of the present invention. In this embodiment, the well bore 12, enlarged cavity 20 and articulated well bore 32 are positioned and formed as previously described in connection with FIG. 1. In this embodiment, the second subterranean zone is also a coal seam. It will be understood that other subterranean formations and/or other low pressure, ultra-low pressure, and low porosity subterranean zones can be similarly accessed using the dual radius well system of the present invention to remove and/or produce water, hydrocarbons and other fluids in the zone, to treat minerals in the zone prior to mining operations, or to inject or introduce a gas, fluid or other substance into the zone.

In an alternative embodiment, the well bores 12 and 12' are formed first, followed by the cavities 20 and 20'. Then, articulated well bores 36 and 36' may be formed. It will be understood that similar modifications to the order of formation may be made, based on the production requirements and expected mining plan of the subsurface formations.

Referring to FIG. 8, after production and degasification is completed as to coal seam 15, a second coal seam 15' may be degasified following a similar method used to prepare coal seam 15. Production equipment for coal seam 15 is removed and well bore 12 is extended below coal seam 15 to form well bore 12' to the target coal seam 15'. The well bore 12' intersects, penetrates and continues below the coal seam 15'. The well bore 12' may be lined with a suitable well casing 16' that terminates at or above the upper level of the coal seam 15'. The well casing 16' may connect to and extend from well casing 16, or may be formed as a separate unit, installed after well casing 16 is removed, and extending from the surface 14 through well bores 12 and 12'. Casing 16' is also used to seal off cavity 20 from well bores 12 and 12' during production and drilling operations directed toward coal seam 15'.

The well bore 12' is logged either during or after drilling in order to locate the exact vertical depth of the coal seam 15'. As a result, the coal seam 15' is not missed in subsequent drilling operations, and techniques used to locate the coal seam 15' while drilling need not be employed. An enlarged cavity 20' is formed in the well bore 12' at the level of the coal seam 15'. The enlarged cavity 20' provides a collection point for fluids drained from the coal seam 15' during production operations and provides a reservoir for water separation of the fluids accumulated from the well bore pattern.

In one embodiment, the enlarged cavity 20' has a radius of approximately eight feet and a vertical dimension which equals or exceeds the vertical dimension of the coal seam 15'. The enlarged cavity 20' is formed using suitable underreaming techniques and equipment. A portion of the well bore 12' continues below the enlarged cavity 20' to form a sump 22' for the cavity 20'.

An articulated well bore 30 extends from the surface 14 to both the enlarged cavity 20 of the well bore 12 and the enlarged cavity 20' of the well bore 12'. The articulated well bore 30 includes portions 32 and 34 and radiused portion 36 interconnecting the portions 32 and 34. The articulated well bore also includes portions 32' and 34' and a curved or radiused portion 36' interconnecting the portions 32' and 34'. Portions 32', 34' and 36' are formed as previously described in connection with FIG. 1 and portions 32, 34 and 36. The portion 34' lies substantially in the plane of the coal seam 15' and intersects the enlarged cavity 20' of the well bore 12'.

In the illustrated embodiment, the articulated well bore 30 is offset a sufficient distance from the well bore 12 at the surface 14 to permit the large radius curved portions 36 and 36' and any desired portions 34 and 34' to be drilled before intersecting the enlarged cavity 20 or 20'. To provide the curved portion 36 with a radius of 100–150 feet, the articulated well bore 30 is offset a distance of about 300 feet from the well bore 12. With a curved portion 36 having a radius of 100–150 feet, the curved portion 36' will have a longer radius than that of curved portion 36, depending on the vertical depth of coal seam 15' below the coal seam 15. This spacing minimizes the angle of the curved portion 36 to reduce friction in the bore 30 during drilling operations. As a result, reach of the articulated drill string drilled through the articulated well bore 30 is maximized. Because the shallower coal seam 15 is usually produced first, the spacing between articulated well bore 30 and well bore 12 is optimized to reduce friction as to curved portion 36 rather than curved portion 36'. This may effect the reach of drill string 40 in forming well bore pattern 50' within coal seam 15'. As discussed below, another embodiment of the present invention includes locating the articulated well bore 30 significantly closer to the well bore 12 at the surface 14, and thereby locating the articulated well bore 30 closer to well bore 12'.

As described above, the articulated well bore 30 is drilled using articulated drill string 40 that includes a suitable down-hole motor and bit 42. A measurement while drilling (MWD) device 44 is included in the articulated drill string 40 for controlling the orientation and direction of the well bore drilled by the motor and bit 42. The portion 32 of the articulated well bore 30 is lined with a suitable casing 38. A casing 38' coupled to casing 38 may be used to enclose the portion 32' of articulated well bore 30 formed by formed by drilling beyond the kickoff point for curved portion 36. Casing 38' is also used to seal off the curved radius portion 36 of the articulated well bore 30.

After the enlarged cavity 20' has been successfully intersected by the articulated well bore 30, drilling is continued through the cavity 20' using the articulated drill string 40 and an appropriate drilling apparatus to provide a well bore pattern 50' in the coal seam 15'. The well bore pattern 50' and other such well bores include sloped, undulating, or other inclinations of the coal seam 15' or other subterranean zone. During this operation, gamma ray logging tools and conventional measurement while drilling devices may be employed to control and direct the orientation of the drill bit to retain the well bore pattern 50' within the confines of the coal seam 15' and to provide substantially uniform coverage of a desired area within the coal seam 15'. The well bore pattern 50' may be constructed similar to well bore pattern 50 as described above. Further information regarding the well bore pattern is described in more detail above in connection with FIGS. 4–7 and below in connection with FIG. 12.

Drilling fluid or "mud" my be used in connection with drilling the drainage pattern 50' in the same manner as described above in connection with FIG. 1 for drilling the well bore pattern 50. At the intersection of the enlarged cavity 20' by the articulated well bore 30, a pump 52 is installed in the enlarged cavity 20' to pump drilling fluid and cuttings to the surface 14 through the well bores 12 and 12'. This eliminates the friction of air and fluid returning up the articulated well bore 30 and reduces down-hole pressure to nearly zero. Accordingly, coal seams and other subterranean zones having ultra low pressures below 150 psi can be accessed from the surface. Additionally, the risk of combining air and methane in the well is eliminated.

Figure 9A:
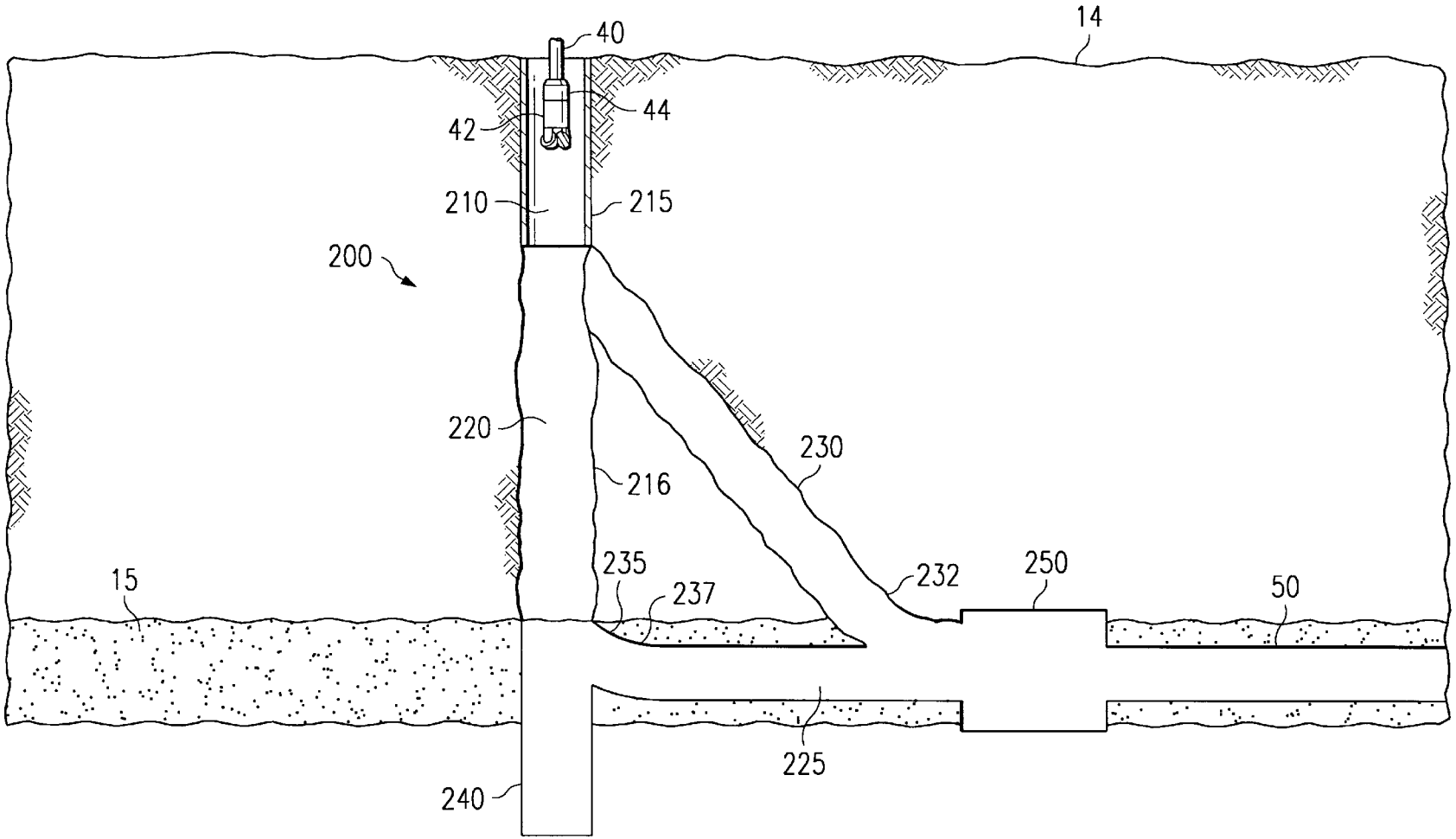
FIG. 9A is a cross-sectional diagram illustrating formation of a well bore pattern in a subterranean zone through an articulated surface well intersecting a cavity well at the surface in accordance with another embodiment of the present invention.

FIG. 9A illustrates a dual radius articulated well combination 200 for accessing a subterranean zone from the surface in accordance with another embodiment of the present invention. In this embodiment, the subterranean zone is a coal seam. It will be understood that other subterranean formations and/or other low pressure, ultra-low pressure, and low porosity subterranean zones can be similarly accessed using the dual radius articulated well system of the present invention to remove and/or produce water, hydrocarbons and other fluids in the zone, to treat minerals in the zone prior to mining operations, or to inject or introduce a gas, fluid or other substance into the subterranean zone.

Figure 10:
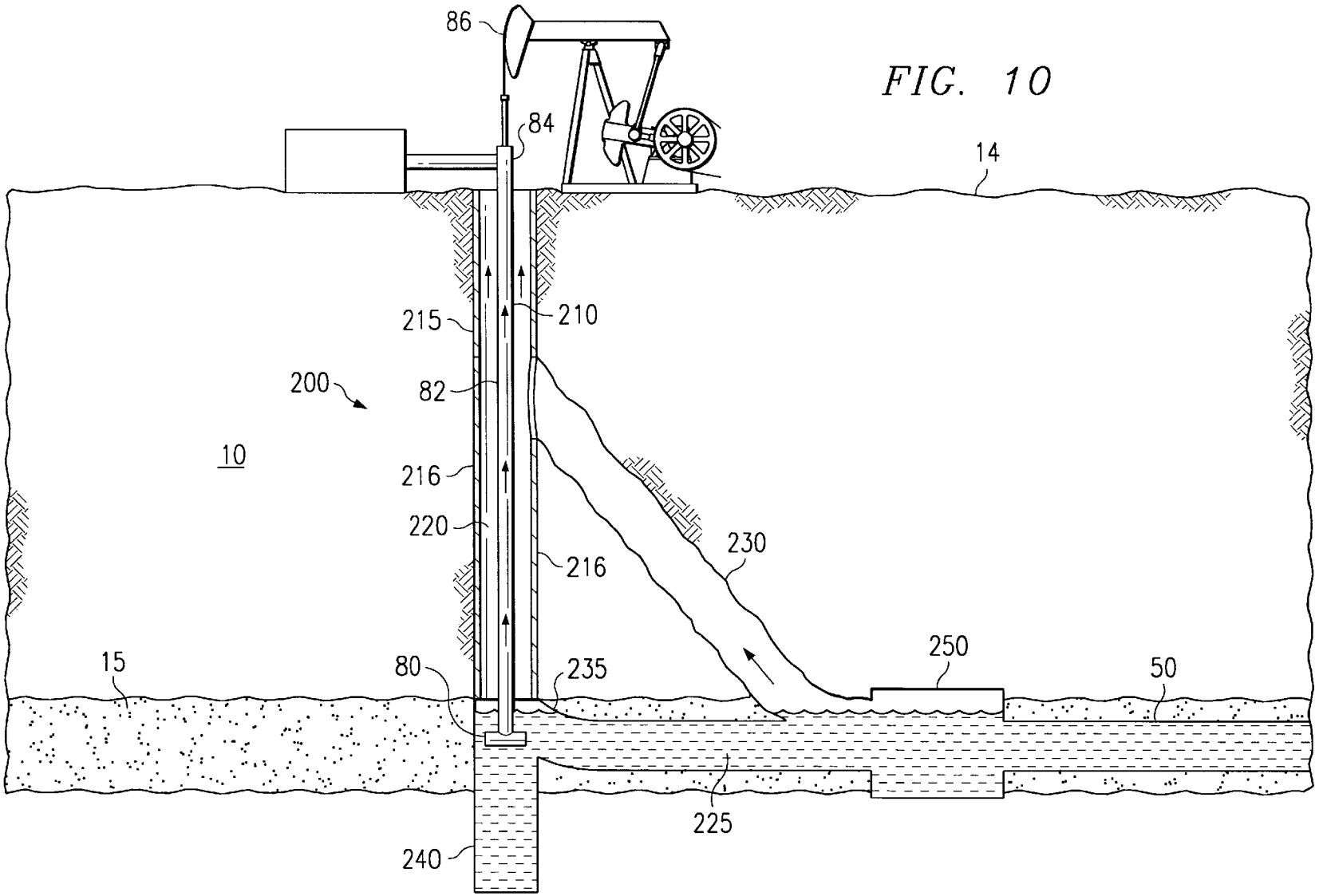
FIG. 10 is a diagram illustrating production of fluids from a well bore pattern in a subterranean zone through a well bore in accordance with another embodiment of the present invention.
Figure 11:
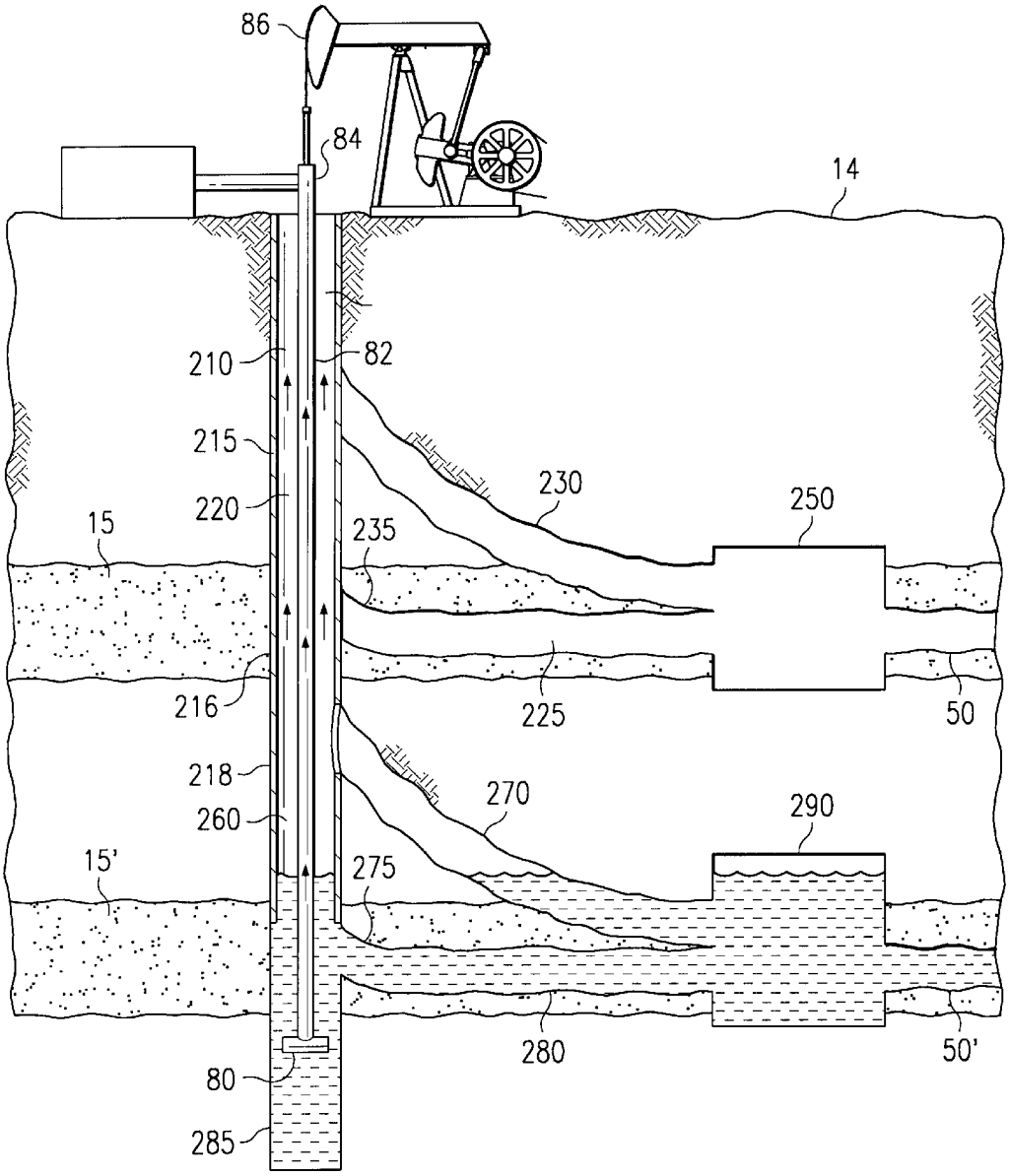
FIG. 11 is a diagram illustrating the production of fluids from well bore patterns in dual subterranean zones through a well bore in accordance with another embodiment of the present invention.

Referring to FIG. 9A, a well bore 210 extends from a limited drilling and production area on the surface 14 to a first articulated well bore 230. The well bore 210 may be lined with a suitable well casing 215 that terminates at or above the level of the intersection of the articulated well bore 230 with the well bore 210. A second well bore 220 extends from the intersection of the well bore 210 and the first articulated well bore 230 to a second articulated well bore 235. The second well bore 220 is in substantial alignment with the first well bore 210, such that together they form a continuous well bore. In FIGS. 9–11, well bores 210 and 220 are illustrated substantially vertical; however, it should be understood that well bores 210 and 220 may be formed at any suitable angle relative to the surface 14 to accommodate, for example, surface 14 geometries and attitudes and/or the geometric configuration or attitude of a subterranean resource. An extension 240 to the second well bore 220 extends from the intersection of the second well bore 220 and the second articulated well bore 235 to a depth below the coal seam 15.

The first articulated well bore 230 has a radius portion 232. The second articulated well bore 235 has a radius portion 237. The radius portion 232 may be formed having a radius of about one hundred fifty feet. The radius portion 237 is smaller than radius portion 232, and may be formed having a radius of about fifty feet. However, other suitable formation radii may be used to form radius portions 232 and 237.

The first articulated well bore 230 communicates with an enlarged cavity 250. The enlarged cavity 250 is formed at the distal end of the first articulated well bore 230 at the level of the coal seam 15. As described in more detail below, the enlarged cavity 250 provides a junction for intersection of a portion 225 of the articulated well bore 235. Portion 225 of the well bore 235 is formed substantially within the plane of the coal seam 15 and extends from the radius portion 237 to the enlarged cavity 250. In one embodiment, the enlarged cavity 250 has a radius of approximately eight feet and a vertical dimension which equals or exceeds the vertical dimension of the coal seam 15. The enlarged cavity 250 is formed using suitable under-reaming techniques and equipment.

The well bore 235 is formed generally at the intersection of the second well bore 220 and extends through the coal seam 15 and into the enlarged cavity 250. In one embodiment, the well bores 210 and 220 are formed first, followed by the second articulated well bore 235. Then, the enlarged cavity 250 is formed, and the second articulated well bore 230 is drilled to intersect the enlarged cavity 250. However, other suitable drilling sequences may be used.

For example, after formation of well bore 210, the first articulated well bore 230 may be drilled using articulated drill string 40 that includes a suitable down-hole motor and bit 42. A measurement while drilling (MWD) device 44 is included in the articulated drill string 40 for controlling the orientation and direction of the well bore drilled by the motor and bit 42. After the first articulated well bore 230 is formed, the enlarged cavity 250 is formed in the coal seam. The enlarged cavity 250 may be formed by a rotary unit, an expandable cutting tool, a water-jet cutting tool, or other suitable methods of forming a cavity in a subsurface formation. After the enlarged cavity 250 has been formed, drilling is continued through the cavity 250 using the articulated drill string 40 and appropriate drilling apparatus to provide the well bore pattern 50 in the coal seam 15. The well bore pattern 50 and other such well bores include sloped, undulating, or other inclinations of the coal seam 15 or other subterranean zone. During this operation, gamma ray logging tools and conventional measurement while drilling devices may be employed to control and direct the orientation of the drill bit to retain the well bore pattern 50 within the confines of the coal seam 15 and to provide substantially uniform coverage of a desired area within the coal seam 15. Further information regarding the well bore pattern is described in more detail in connection with FIGS. 4–7, above, and FIG. 12, below. Drilling mud and overbalance prevention operations may be conducted in the same manner as described above in connection with FIG. 1. After the well bore pattern 50 has been formed, the articulated drill string 40 is removed from the well bores and used to form the well bore 220. As described above, the second well bore 220 shares a common portion with the articulated well portion 230.

After the well bore 220 is drilled to the depth of the coal seam 15, a subsurface channel is formed by the articulated well bore 235. The second articulated well bore 235 is formed using conventional articulated drilling techniques and interconnects the second well bore 220 and the enlarged cavity 250. As described in more detail in connection with FIG. 10 below, this allows fluids collected through the well bore pattern 50 to flow through the enlarged cavity 250 and along the well bore 235 to be removed via the second well bore 220 and the first well bore 210 to the surface 14. By drilling in this manner, a substantial area of a subsurface formation may be drained or produced from a small area on the surface.

Figure 9B:
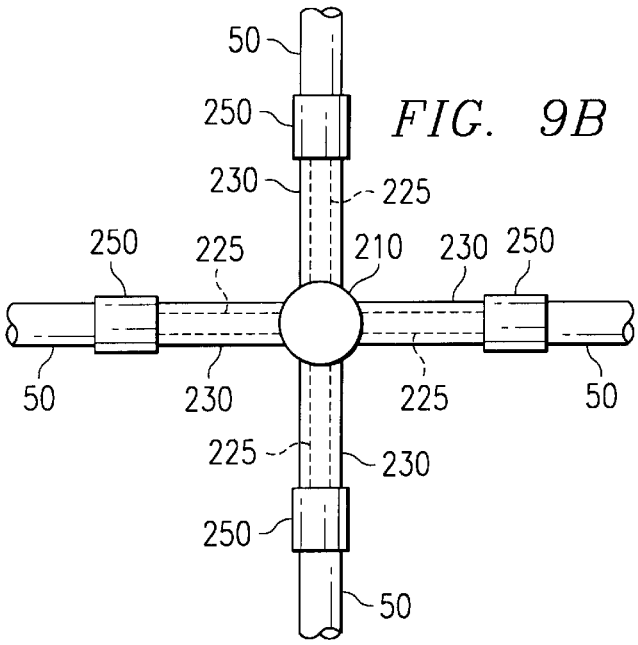
FIG. 9B is a top-plan diagram illustrating formation of multiple well bore patterns in a subterranean zone through multiple articulated surface wells intersecting a single cavity well at the surface in accordance with another embodiment of the present invention.

FIG. 9B illustrates formation of multiple well bore patterns in a subterranean zone through multiple articulated surface wells intersecting a single cavity well at the surface in accordance with another embodiment of the present invention. In this embodiment, a single cavity well bore 210 is used to collect and remove to the surface resources collected from well bore patterns 50. It will be understood that a varying number of multiple well bore patterns 50, enlarged cavities 250, and articulated wells 230 and 235 may be used, depending on the geology of the underlying subterranean formation, desired total drainage area, production requirements, and other factors.

Referring to FIG. 9B, well bores 210 and 220 are drilled at a surface location at the approximate center of a desired total drainage area. As described above, articulated well bores 230 are drilled from a surface location proximate to or in common with the well bores 210 and 220. Well bore patterns 50 are drilled within the target subterranean zone from each articulated well bore 230. Also from each of the articulated well bores 230, an enlarged cavity 250 is formed to collect resources draining from the well bore patterns 50. Well bores 235 are drilled to connect each of the enlarged cavities 250 with the well bores 210 and 220 as described above in connection with FIG. 9A.

Resources from the target subterranean zone drain into well bore patterns 50, where the resources are collected in the enlarged cavities 250. From the enlarged cavities 250, the resources pass through the well bores 235 and into the well bores 210 and 220. Once the resources have been collected in well bores 210 and 220, they may be removed to the surface by the methods as described above.

FIG. 10 illustrates production of fluids and gas from the well bore pattern 50 in the coal seam 15 in accordance with another embodiment of the present invention. In this embodiment, after the well bores 210, 220, 230 and 235, as well as desired well bore patterns 50, have been drilled, the articulated drill string 40 is removed from the well bores. In one aspect of this embodiment, the first articulated well bore 230 is cased over and the well bore 220 is lined with a suitable well casing 216. In the illustrated aspect of this embodiment, only the well bore 220 is cased by casing 216 and the first articulated well bore 230 is left in communication with the first well bore 210.

Referring to FIG. 10, a down hole pump 80 is disposed in the lower portion of the well bore 220 above the extension 240. The extension 240 provides a reservoir for accumulated fluids allowing intermittent pumping without adverse effects of a hydrostatic head caused by accumulated fluids in the well bore.

The down hole pump 80 is connected to the surface 14 via a tubing string 82 and may be powered by sucker rods 84 extending down through the well bores 210 and 220 of the tubing string 82. The sucker rods 84 are reciprocated by a suitable surface mounted apparatus, such as a powered walking beam 86 to operate the down hole pump 80. The down hole pump 80 is used to remove water and entrained coal fines from the coal seam 15 via the well bore pattern 50. Once the water is removed to the surface, it may be treated for separation of methane which may be dissolved in the water and for removal of entrained fines. After sufficient water has been removed from the coal seam 15, pure coal seam gas may be allowed to flow to the surface 14 through the annulus of the well bores 210 and 220 around the tubing string 82 and removed via piping attached to a wellhead apparatus. Alternatively or additionally, pure coal seam gas may be allowed to flow to the surface 14 through the annulus of the first articulated well bore 230. At the surface, the methane is treated, compressed and pumped through a pipeline for use as a fuel in a conventional manner. The down hole pump 80 may be operated continuously or as needed to remove water drained from the coal seam 15 into the extension 240.

FIG. 11 illustrates a method and system for drilling the well bore pattern 50 in a second subterranean zone, located below the coal seam 15, in accordance with another embodiment of the present invention. In this embodiment, the well bores 210 and 220, the articulated well bores 230 and 235, the enlarged cavity 250, and the well bore pattern 50 are positioned and formed as previously described in connection with FIG. 9A. In this embodiment, the second subterranean zone is also a coal seam. It will be understood that other subterranean formations and/or other low pressure, ultra-low pressure, and low porosity subterranean zones can be similarly accessed using the dual radius well system of the present invention to remove and/or produce water, hydrocarbons and other fluids in the zone, to treat minerals in the zone prior to mining operations, or to inject or introduce a gas, fluid or other substance into the zone.

Referring to FIG. 11, after production and degasification is completed as to coal seam 15, a second coal seam 15' may be degasified following a similar method used to prepare coal seam 15. Production equipment for coal seam 15 is removed and well bore 220 is extended below coal seam 15 to form a well bore 260 to the target coal seam 15'. The well bore 260 intersects, penetrates and continues below the coal seam 15', terminating in an extension 285. The well bore 260 may be lined with a suitable well casing 218 that terminates at or above the upper level of the coal seam 15'. The well casing 218 may connect to and extend from well casing 216, or may be formed as a separate unit, installed after well casing 216 is removed, and extending from the surface 14 through well bores 210, 220, and 260. Casing 260 may also used to seal off articulated well bores 230 and 235 from well bores 210 and 220 during production and drilling operations directed towards coal seam 15'. Well bore 260 is in substantial alignment with the well bores 210 and 220, such that together they form a continuous well bore. In FIG. 11, well bore 260 is illustrated substantially vertical; however, it should be understood that well bore 260 may be formed at any suitable angle relative to the surface 14 and/or well bores 210 and 220 to accommodate, for example, the geometric configuration or attitude of a subterranean resource.

In a manner similar to that described in connection with FIG. 9A above, a first articulated well bore 270, an enlarged cavity 290, a well bore pattern 50', and a second articulated well bore 275 are formed in comparable relation to coal seam 15'. Similarly, water, hydrocarbons, and other fluids are produced from coal seam 15' in a manner substantially the same as described above in connection with FIG. 10. For example, resources from the target coal seam 15' drain into well bore patterns 50', where the resources are collected in the enlarged cavities 290. From the enlarged cavities 290, the resources pass through a portion 280 of the well bore 275 and into the well bores 210, 220, and 260. Once the resources have been collected in well bores 210, 220, and 260, they may be removed to the surface by the methods as described above.

Figure 12:
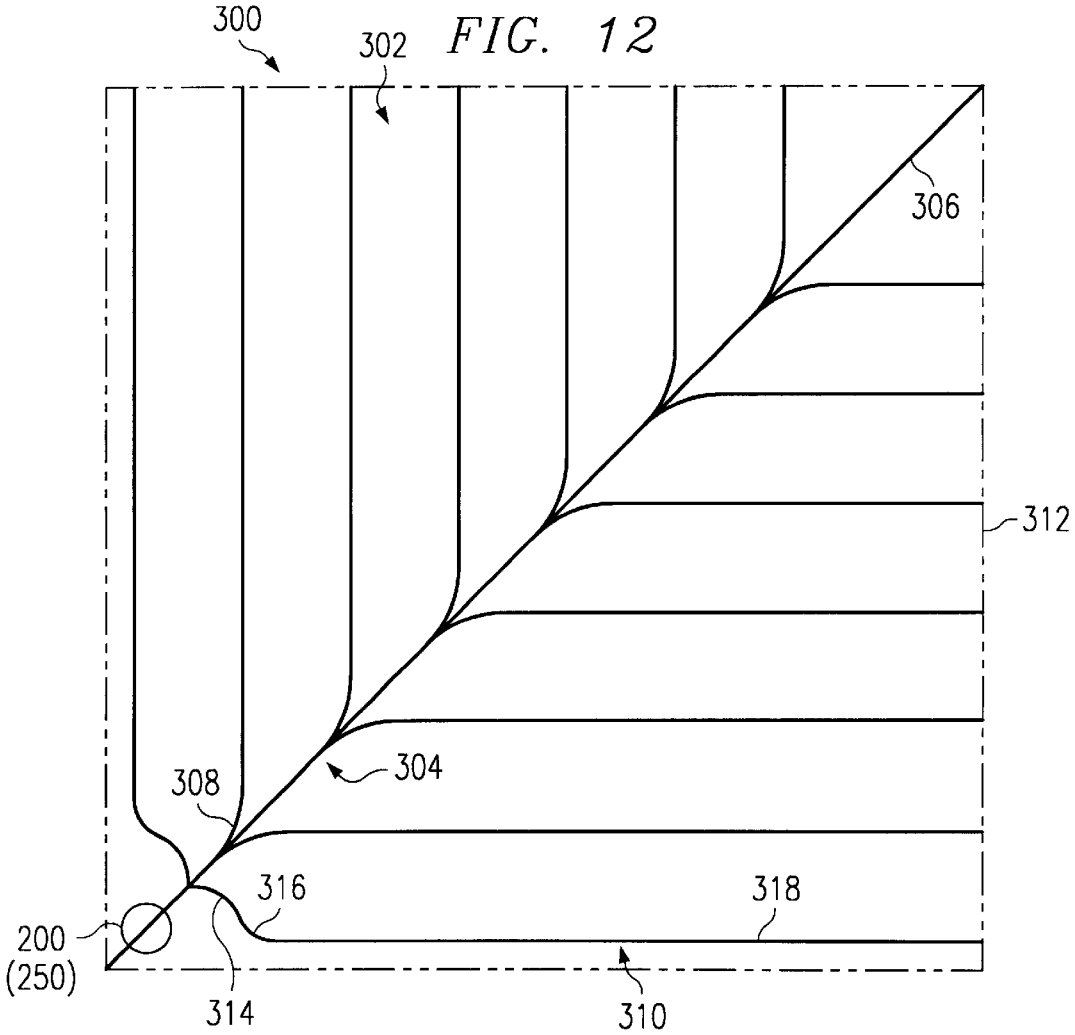
FIG. 12 is a top plan diagram illustrating a pinnate well bore pattern for accessing deposits in a subterranean zone in accordance with another embodiment of the present invention.

FIG. 12 illustrates a pinnate well bore pattern 300 in accordance with another embodiment of the present invention. In this embodiment, the pinnate well bore pattern 300 provides access to a substantially square area 302 of a subterranean zone. A number of the pinnate patterns 300 may be used together in dual, triple, and quad pinnate structures to provide uniform access to a large subterranean region.

Referring to FIG. 12, the enlarged cavity 250 defines a first corner of the area 302, over which a pinnate well bore pattern 300 extends. The enlarged cavity 250 defines a first corner of the area 302. The pinnate pattern 300 includes a main well bore 304 extending diagonally across the area 302 to a distant corner 306 of the area 302. Preferably, the well bores 210 and 230 are positioned over the area 302 such that the well bore 304 is drilled up the slope of the coal seam 15. This will facilitate collection of water, gas, and other fluids from the area 302. The well bore 304 is drilled using the articulated drill string 40 and extends from the enlarged cavity 250 in alignment with the articulated well bore 230.

A plurality of lateral well bores 310 extend from the opposites sides of well bore 304 to a periphery 312 of the area 302. The lateral bores 310 may mirror each other on opposite sides of the well bore 304 or may be offset from each other along the well bore 304. Each of the lateral well bores 310 includes a first radius curving portion 314 extending from the well bore 304, and an elongated portion 318. The first set of lateral well bores 310 located proximate to the cavity 250 may also include a second radius curving portion 316 formed after the first curved portion 314 has reached a desired orientation. In this set, the elongated portion 318 is formed after the second curved portion 316 has reached a desired orientation. Thus, the first set of lateral well bores 310 kicks or turns back towards the enlarged cavity 250 before extending outward through the formation, thereby extending the drainage area back towards the cavity 250 to provide uniform coverage of the area 302. For uniform coverage of the square area 302, pairs of lateral well bores 310 are substantially evenly spaced on each side of the well bore 304 and extend from the well bore 304 at an angle of approximately 45 degrees. The lateral well bores 310 shorten in length based on progression away from the enlarged cavity 250 in order to facilitate drilling of the lateral well bores 310.

The pinnate well bore pattern 300 using a single well bore 304 and five pairs of lateral well bores 310 may drain a coal seam area of approximately 150 acres in size. Where a smaller area is to be drained, or where the coal seam has a different shape, such as a long, narrow shape, or other shapes due to surface or subterranean topography, alternate pinnate well bore patterns may be employed by varying the angle of the lateral well bores 310 to the well bore 304 and the orientation of the lateral well bores 310. Alternatively, lateral well bores 310 can be drilled from only one side of the well bore 304 to form a one-half pinnate pattern.

The well bore 304 and the lateral well bores 310 are formed by drilling through the enlarged cavity 250 using the articulated drill string 40 and an appropriate drilling apparatus. During this operation, gamma ray logging tools and conventional measurement while drilling (MWD) technologies may be employed to control the direction and orientation of the drill bit so as to retain the well bore pattern within the confines of the coal seam 15 and to maintain proper spacing and orientation of the well bores 304 and 310. In a particular embodiment, the well bore 304 is drilled with an incline at each of a plurality of lateral kick-off points 308. After the well bore 304 is complete, the articulated drill string 40 is backed up to each successive lateral point 308 from which a lateral well bore 310 is drilled on each side of the well bore 304. It will be understood that the pinnate well bore pattern 300 may be otherwise suitably formed in accordance with the present invention.

Figure 13:
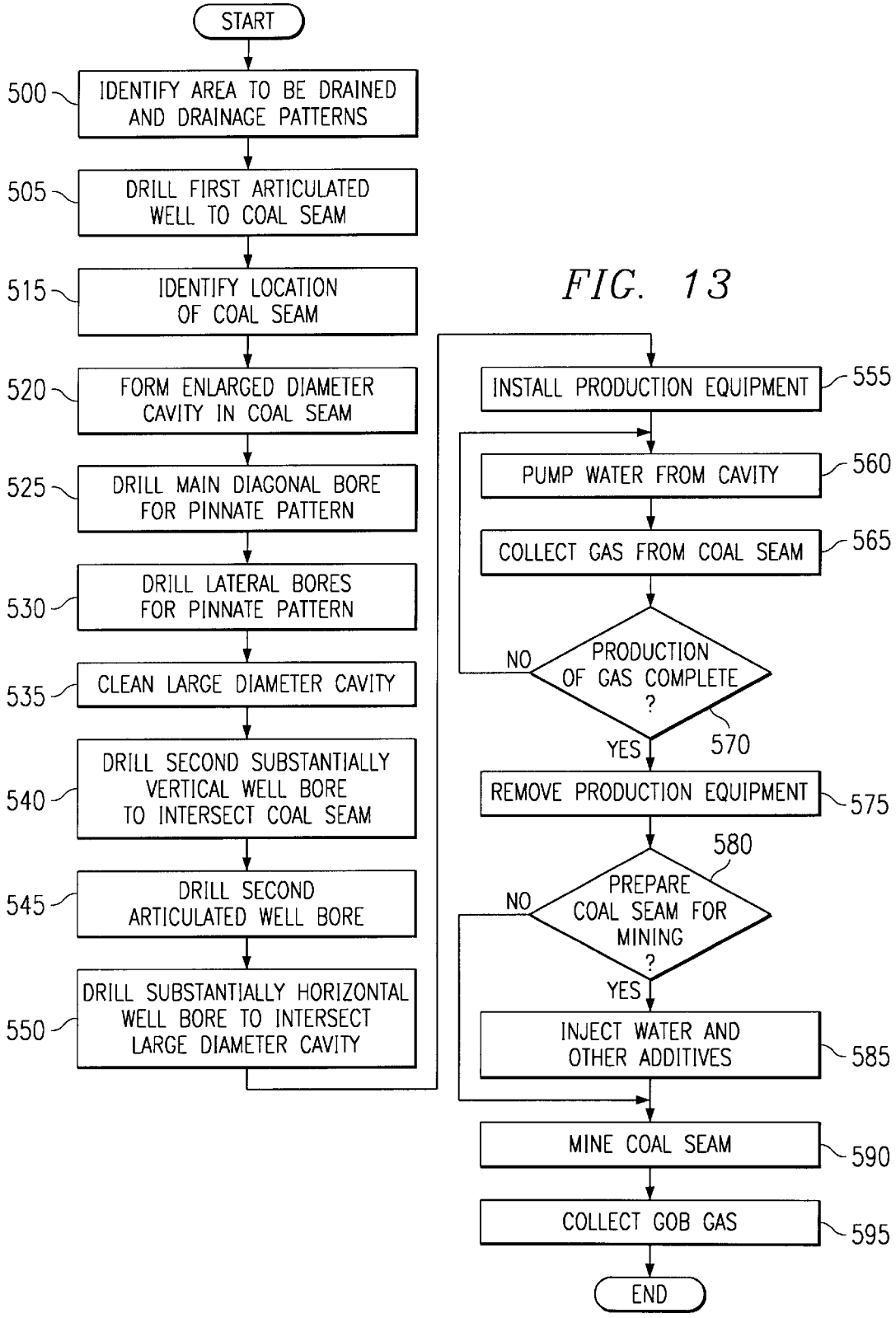
FIG. 13 is a flow diagram illustrating a method for preparing a coal seam for mining operations in accordance with another embodiment of the present invention.

FIG. 13 is a flow diagram illustrating a method for preparing the coal seam 15 for mining operations in accordance with another embodiment of the present invention. In this embodiment, the method begins at step 500 in which areas to be drained and well bore patterns 50 to provide drainage for the areas are identified. Preferably, the areas are aligned with a grid of a mining plan for the region. Pinnate structures 100, 120, 140, 144, and 300 may be used to provide optimized coverage for the region. It will be understood that other suitable patterns may be used to degasify the coal seam 15.

Proceeding to step 505, the first articulated well 230 is drilled to the coal seam 15. At step 515, down hole logging equipment is utilized to exactly identify the location of the coal seam in the first articulated well bore 230. At step 520, the enlarged cavity 250 is formed in the first articulated well bore 230 at the location of the coal seam 15. As previously discussed, the enlarged cavity 250 may be formed by under reaming and other conventional techniques. At step 525, the well bore 104 for the pinnate well bore pattern 100 is drilled through the articulated well bore 30 into the coal seam 15. After formation of the well bore 104, lateral well bores 110 for the pinnate well bore pattern 100 are drilled at step 530. As previously described, lateral kick-off points may be formed in the well bore 104 during its formation to facilitate drilling of the lateral well bores 110.

Next, at step 535, the enlarged cavity 250 is cleaned in preparation for installation of down hole production equipment. The enlarged cavity 250 may be cleaned by pumping compressed air down the well bores 210 and 230 or other suitable techniques. Next, at step 540, the second well bore 220 is drilled from or proximate to the articulated well bore 230 to intersect the coal seam 15. At step 545, the second articulated well bore 235 and extension 240 are formed. Next, at step 550, the well bore 225 is drilled to intersect the enlarged cavity 250.

At step 555, production equipment is installed in the well bores 210 and 220. The production equipment includes a sucker rod pump extending down into the bottom portion of well bore 220, above the extension 240 for removing water from the coal seam 15. The removal of water will drop the pressure of the coal seam and allow methane gas to diffuse and be produced up the annulus of the well bores 210 and 220 and the articulated well bore 230.

Proceeding to step 560, water that drains from the well bore pattern 100 into the bottom portion of well bore 220 is pumped to the surface with the rod pumping unit. Water may be continuously or intermittently be pumped as needed to remove it from the bottom portion of well bore 220. At step 565, methane gas diffused from the coal seam 15 is continuously collected at the surface 14. Next, at decisional step 570, it is determined whether the production of gas from the coal seam 15 is complete. In one embodiment, the production of gas may be complete after the cost of the collecting the gas exceeds the revenue generated by the well. In another embodiment, gas may continue to be produced from the well until a remaining level of gas in the coal seam 15 is below required levels for mining operations. If production of the gas is not complete, the No branch of decisional step 570 returns to steps 560 and 565 in which water and gas continue to be removed from the coal seam 15. Upon completion of production, the Yes branch of decisional step 570 leads to step 575 in which the production equipment is removed.

Next, at decisional step 580, it is determined whether the coal seam 15 is to be further prepared for mining operations. If the coal seam 15 is to be further prepared for mining operations, the Yes branch of decisional step 580 leads to step 585 in which water and other additives may be injected back into the coal seam 15 to re-hydrate the coal seam in order to minimize dust, to improve the efficiency of mining, and to improve the mined product.

Step 585 and the No branch of decisional step 580 lead to step 590 in which the coal seam 15 is mined. The removal of the coal from the seam causes the mined roof to cave and fracture into the opening behind the mining process. The collapsed roof creates gob gas which may be collected at step 595 through the well bores 210 and 220 and/or first articulated well bore 230. Accordingly, additional drilling operations are not required to recover gob gas from a mined coal seam. Step 595 leads to the end of the process by which a coal seam is efficiently degasified from a minimum surface area. The method provides a symbiotic relationship with the mine to remove unwanted gas prior to mining and to re-hydrate the coal prior to the mining process. Furthermore, the method allows for efficient degasification in steep, rough, or otherwise restrictive topology.

Although the present invention has been described with several embodiments, various changes and modifications may be suggested to one skilled in the art. It is intended that the present invention encompass such changes and modifications as fall within the scope of the appended claims.

What is claimed is:

1. A method for accessing a subsurface formation from the surface, comprising:

providing a substantially vertical well bore from a surface to a target zone;

providing a first articulated well bore extending from the substantially vertical well bore to the target zone, the first articulated well bore diverging from the substantially vertical well bore between the surface and the target zone;

providing a second articulated well bore extending from the substantially vertical well bore and intersecting the first articulated well bore at a junction proximate the target zone; and forming a well bore pattern extending from the junction into the target zone.

2. The method of claim 1, further comprising removing resources from the target zone through the substantially vertical well bore.

3. The method of claim 1, wherein forming the well bore pattern comprises forming the well bore pattern through the first articulated well bore.

4. The method of claim 1, wherein forming the well bore pattern comprises forming the well bore pattern through the second articulated well bore.

5. The method of claim 1, further comprising forming an enlarged cavity in the target zone at an end of the well bore pattern proximate to the first and second articulated well bores, the second articulated well bore communicating between the substantially vertical well bore and the enlarged cavity.

6. The method of claim 5, wherein forming the enlarged cavity comprises forming an enlarged diameter cavity.

7. The method of claim 5, wherein forming the enlarged cavity comprises forming the enlarged cavity substantially within a coal seam.

8. The method of claim 5, wherein forming the well bore pattern comprises:

forming a main well bore extending from the enlarged cavity into the target zone; and forming a plurality of lateral well bores extending outwardly from opposite sides of the main well bore.

9. The method of claim 8, wherein forming the lateral well bores comprises forming the lateral well bores substantially equally spaced apart from each other.

10. The method of claim 1, wherein forming the well bore pattern comprises forming a pinnate well bore pattern.

11. The method of claim 10, wherein forming the pinnate well bore pattern comprises forming a plurality of lateral well bores extending from a main well bore into the target zone.

12. The method of claim 1, further comprising:

disposing a vertical pump in the substantially vertical well bore; and removing resources collected in the substantially vertical well bore to the surface using the vertical pump.

13. The method of claim 12, wherein disposing the vertical pump comprises providing a sucker-rod pump.

14. A method for extracting resources from a subsurface formation, comprising:

providing a substantially vertical well bore from a surface to a first target zone and a second target zone;

providing a first articulated well bore extending from the substantially vertical well bore to the first target zone, the first articulated well bore diverging from the substantially vertical well bore between the surface and the first target zone;

providing a second articulated well bore extending from the substantially vertical well bore and intersecting the first articulated well bore at a first junction proximate the first target zone;

providing a first well bore pattern extending from the first junction into the first target zone;

removing resources from the first target zone through the substantially vertical well bore;

providing a third articulated well bore extending from the substantially vertical well bore to the second target zone, the third articulated well bore diverging from the substantially vertical well bore between the surface and the second target zone;

providing a fourth articulated well bore extending from the substantially vertical well bore and intersecting the third articulated well bore at a second junction proximate the second target zone;

providing a second well bore pattern extending from the second junction into the second target zone; and removing resources from the second target zone through the substantially vertical well bore.

15. The method of claim 14, wherein providing the first and second well bore patterns comprises forming the first and second well bore patterns through the respective first and third articulated well bores.

16. The method of claim 14, further comprising:

providing a first cavity in the first target zone at an end of the first well bore pattern proximate to the first junction, the second articulated well bore communicating between the substantially vertical well bore and the first cavity; and providing a second cavity in the second target zone at an end of the second well bore pattern proximate to the second junction, the fourth articulated well bore communicating between the substantially vertical well bore and the second cavity.

17. The method of 16, wherein providing the first and second cavities comprises providing the first and second cavities disposed substantially within the respective first and second target zones.

18. The method of claim 14, wherein providing the second and fourth articulated well bores comprises providing the second and fourth articulated well bores disposed substantially within the respective first and second target zones.

19. The method of claim 14, wherein providing the first and second well bore patterns comprise providing pinnate well bore patterns.

20. A system for accessing a subsurface formation from the surface, comprising:

a first well bore extending downwardly from the surface;

a second well bore extending from the first well bore to a target zone, the second well bore diverging from the first well bore between the surface and the target zone;

a third well bore extending from the first well bore and intersecting the second well bore at a junction proximate the target zone; and a well bore pattern extending from the junction into the target zone.

21. The system of claim 20, further comprising a cavity disposed within the target zone at an end of the well bore pattern proximate to the junction, the third well bore providing communication between the cavity and the first well bore.

22. The system of claim 20, further comprising a pump disposed in the first well bore and operable to lift resources collected in the first well bore to the surface.

23. The system of claim 22, wherein the pump comprises a sucker-rod pump.

24. The system of claim 20, wherein the third well bore is disposed substantially within the target zone.

25. The system of claim 20, wherein the well bore pattern comprises a pinnate well bore pattern.

26. The system of claim 20, wherein the well bore pattern comprises:

a main well bore extending from the junction; and a plurality of lateral well bores extending outwardly from the main well bore.

27. The system of claim 26, wherein the plurality of lateral well bores are disposed substantially equally spaced apart from each other.

28. A system for extracting resources from a subsurface formation, comprising:

a substantially vertical well bore extending from a surface to a first target zone and a second target zone;

a first articulated well bore extending from the substantially vertical well bore to the first target zone, the first articulated well bore diverging from the substantially vertical well bore between the surface and the first target zone;

a first well bore pattern extending from the first articulated well bore in the first target zone operable to collect resources from the first target zone;

a second articulated well bore operable to communicate resources from the first well bore pattern to the substantially vertical well bore;

a third articulated well bore extending from the substantially vertical well bore to the second target zone, the third articulated well bore diverging from the substantially vertical well bore between the surface and the second target zone;

a second well bore pattern extending from the third articulated well bore in the second target zone operable to collect resources from the second target zone;

a fourth articulated well bore operable to communicate resources from the second well bore pattern to the substantially vertical well bore; and a vertical pump disposed in the substantially vertical well bore and operable to lift the resources collected in the substantially vertical well bore to the surface.

29. The system of claim 28, further comprising:

a first cavity disposed within the first target zone at an end of the first well bore pattern proximate to the first articulated well bore, the second articulated well bore operable to communicate the resources from the first cavity to the substantially vertical well bore; and a second cavity disposed within the second target zone at an end of the second well bore pattern proximate to the third articulated well bore, the fourth articulated well bore operable to communicate the resources from the second cavity to the substantially vertical well bore.

30. The system of claim 28, wherein the second and fourth articulated well bore are disposed substantially within the respective first and second target zones.

31. The system of claim 28, wherein the first and second well bore patterns comprise pinnate well bore patterns.

32. The system of claim 31, wherein each pinnate well bore pattern comprises a plurality of lateral well bores extending from a respective main well bore disposed substantially within a respective target zone.

33. The system of claim 28, wherein the vertical pump comprises a sucker-rod pump.

34. The system of claim 28, wherein each of the first and second well bore patterns comprise:

a substantially horizontal diagonal well bore extending from a first end of an area of a subterranean zone to a second end of the area of the subterranean zone; and a plurality of lateral well bores extending in spaced apart relation to each other from the diagonal well bore to a periphery of the area.

35. The system of claim 34, wherein the first end of the area is disposed proximate the respective first and third articulated well bores, and wherein a length of the lateral well bores progressively decreases as a distance between the lateral well bore and the first end increases.

* * * * *

UNITED STATES PATENT AND TRADEMARK OFFICE

CERTIFICATE OF CORRECTION

PATENT NO. : 6,425,448 B1 
DATED : July 30, 2002
INVENTOR(S) : Joseph A. Zupanick and Monty H. Rial It is certified that error appears in the above-identified patent and that said Letters Patent is hereby corrected as shown below:

Title page,
Item [73], Assignee, after "CDX Gas," delete "L.L.P." and insert -- LLC --.

Signed and Sealed this

Fifteenth Day of April, 2003

JAMES E. ROGAN
*Director of the United States Patent and Trademark Office*